US009207019B2

(12) United States Patent
Van Der Merwe et al.

(10) Patent No.: US 9,207,019 B2
(45) Date of Patent: Dec. 8, 2015

(54) HEAT RECOVERY FOR BITUMEN FROTH TREATMENT PLANT INTEGRATION WITH SEALED CLOSED-LOOP COOLING CIRCUIT

(75) Inventors: Shawn Van Der Merwe, Calgary (CA); Edward Casper Degraaf, Jr., Bellingham, WA (US); Kenneth Ellard Corbett, Alberta (CA)

(73) Assignee: FORT HILLS ENERGY L.P., Calgary (Alberta) (CA)

( * ) Notice: Subject to any disclaimer, the term of this patent is extended or adjusted under 35 U.S.C. 154(b) by 245 days.

(21) Appl. No.: 14/111,870

(22) PCT Filed: Mar. 27, 2012

(86) PCT No.: PCT/CA2012/050186

§ 371 (c)(1),
(2), (4) Date: Nov. 13, 2013

(87) PCT Pub. No.: WO2012/139216

PCT Pub. Date: Oct. 18, 2012

(65) Prior Publication Data

US 2014/0291209 A1 Oct. 2, 2014

(51) Int. Cl.
*C10G 1/00* (2006.01)
*F28D 1/02* (2006.01)
(Continued)

(52) U.S. Cl.
CPC *F28D 1/02* (2013.01); *C10G 1/047* (2013.01); *C10G 2300/1033* (2013.01);
(Continued)

(58) Field of Classification Search
CPC ..... F28D 1/02; F28D 21/001; C10G 1/00; C10G 1/047
See application file for complete search history.

(56) References Cited

U.S. PATENT DOCUMENTS 181,668 A 8/1876 Gregg et al.
1,261,671 A 4/1918 Zachert
(Continued)

FOREIGN PATENT DOCUMENTS

CA 918091 A1 1/1973
CA 918588 A1 1/1973
(Continued)

OTHER PUBLICATIONS

Andrews et al. "Great Canadian Oil Sands Experience in Commercial Processing of Athabasca Tar Sands" American Chemical Society San Francisco Meeting Apr. 2-5, 1968, p. F5-F18.
(Continued)

*Primary Examiner* — Brian McCaig
(74) *Attorney, Agent, or Firm* — Baker & Hostetler LLP

(57) ABSTRACT

A system and process for recovering heat from a bitumen froth treatment plant use a sealed closed-loop heat transfer circuit. The system has a heat removal exchanger associated with the plant and receiving hot froth treatment process stream; heat recovery exchanger; the circuit; and an oil sands process fluid line. The circuit includes piping circulating heat exchange media having uncontaminated and low fouling properties. The piping includes a supply line to the heat removal exchanger and a return line for providing heated media to the recovery exchanger. The circuit has a pump for pressurizing the heat exchange media; a pressure regulator for regulating pressure of the media. The pump and the pressure maintain the media under pressure in liquid phase. The oil sands process fluid is heated producing a cooled media for reuse in the heat removal exchanger. High and low temperature heat removal exchangers can be used.

26 Claims, 11 Drawing Sheets

(51) Int. Cl.
*C10G 1/04* (2006.01)
*F28D 21/00* (2006.01)

(52) U.S. Cl.
CPC . *C10G 2300/302* (2013.01); *C10G 2300/4075* (2013.01); *C10G 2300/4081* (2013.01); *C10G 2300/44* (2013.01); *C10G 2300/80* (2013.01); *C10G 2300/805* (2013.01); *F28D 21/0001* (2013.01)

(56) References Cited

U.S. PATENT DOCUMENTS 1,494,375 A 5/1924 Reilly
1,754,119 A 4/1930 Pink
2,010,008 A 8/1935 Bray
2,091,078 A 8/1937 McKittrick et al.
2,111,717 A 3/1938 Young
2,188,013 A 1/1940 Pilat et al.
2,240,008 A 4/1941 Atwell
2,410,483 A 11/1946 Dons et al.
2,853,426 A 9/1958 Peet
2,868,714 A 1/1959 Gilmore
3,278,415 A 10/1966 Doberenz et al.
3,575,842 A 4/1971 Simpson
3,617,468 A * 11/1971 Reyburn et al. ..... 208/408
3,779,902 A 12/1973 Mitchell et al.
3,808,120 A 4/1974 Smith
3,901,791 A 8/1975 Baillie
3,929,625 A 12/1975 Lucas
4,013,542 A 3/1977 Gudelis et al.
4,035,282 A 7/1977 Stuchberry et al.
4,115,241 A 9/1978 Harrison et al.
4,116,809 A 9/1978 Kizior
4,120,775 A 10/1978 Murray et al.
4,140,620 A 2/1979 Paulett
4,209,422 A 6/1980 Zimmerman et al.
4,210,820 A 7/1980 Wittig
4,230,467 A 10/1980 Buchwald
4,251,627 A 2/1981 Calamur
4,314,974 A 2/1982 Libby et al.
4,315,815 A 2/1982 Gearhart
4,321,147 A 3/1982 McCoy et al.
4,324,652 A 4/1982 Hack
4,342,657 A 8/1982 Blair
4,395,330 A 7/1983 Auboir et al.
4,410,417 A 10/1983 Miller et al.
4,425,227 A 1/1984 Smith
4,461,696 A 7/1984 Bock et al.
4,470,899 A 9/1984 Miller et al.
4,495,057 A 1/1985 Amirijafari et al.
4,514,305 A 4/1985 Filby
4,518,479 A 5/1985 Schweigharett et al.
4,532,024 A 7/1985 Haschke et al.
4,539,093 A 9/1985 Friedman et al.
4,545,892 A 10/1985 Cymbalisty et al.
4,572,781 A 2/1986 Krasuk et al.
4,584,087 A 4/1986 Peck
4,609,455 A 9/1986 Weimer et al.
4,634,520 A 1/1987 Angelov et al.
4,640,767 A 2/1987 Zajic et al.
4,644,974 A 2/1987 Zingg
4,648,964 A 3/1987 Leto et al.
4,678,558 A 7/1987 Belluteau et al.
4,722,782 A 2/1988 Graham et al.
4,781,819 A 11/1988 Chirinos et al.
4,802,975 A 2/1989 Mehlberg
4,822,481 A 4/1989 Taylor
4,828,688 A 5/1989 Corti et al.
4,859,317 A 8/1989 Shelfantook et al.
4,888,108 A 12/1989 Farnand
4,906,355 A 3/1990 Lechnick et al.
4,929,341 A 5/1990 Thirumalachar et al.
4,931,072 A 6/1990 Striedieck
4,950,363 A 8/1990 Silvey
4,966,685 A 10/1990 Hall et al.
4,968,413 A 11/1990 Datta et al.
5,022,983 A 6/1991 Myers et al.
5,039,227 A 8/1991 Leung et al.
5,143,598 A 9/1992 Graham et al.
5,186,820 A 2/1993 Schultz et al.
5,223,148 A 6/1993 Tipman et al.
5,236,577 A 8/1993 Tipman et al.
5,264,118 A 11/1993 Cymerman et al.
5,282,984 A 2/1994 Ashrawi
5,443,046 A 8/1995 White
5,558,768 A 9/1996 Ikura et al.
5,645,714 A 7/1997 Strand et al.
5,690,811 A 11/1997 Davis et al.
5,817,398 A 10/1998 Hollander
5,871,634 A 2/1999 Wiehe et al.
5,876,592 A 3/1999 Tipman et al.
5,879,540 A 3/1999 Zinke et al.
5,914,010 A 6/1999 Hood et al.
5,937,817 A 8/1999 Schanz et al.
5,948,241 A 9/1999 Owen
5,954,277 A 9/1999 Maciejewski et al.
5,968,349 A 10/1999 Duyvesteyn et al.
5,985,138 A 11/1999 Humphreys
5,988,198 A 11/1999 Neiman et al.
5,997,723 A 12/1999 Wiehe et al.
6,004,455 A 12/1999 Rendall
6,007,708 A 12/1999 Allcock et al.
6,007,709 A 12/1999 Duyvesteyn et al.
6,019,888 A 2/2000 Mishra et al.
6,036,748 A 3/2000 Wallace et al.
6,076,753 A 6/2000 Maciejewski et al.
6,110,359 A 8/2000 Davis et al.
6,120,678 A 9/2000 Stephenson et al.
6,159,442 A 12/2000 Thumm et al.
6,214,213 B1 4/2001 Tipman et al.
6,355,159 B1 3/2002 Myers et al.
6,358,403 B1 3/2002 Brown et al.
6,391,190 B1 5/2002 Spence et al.
6,482,250 B1 11/2002 Williams et al.
6,497,813 B2 12/2002 Ackerson et al.
6,523,573 B2 2/2003 Robison et al.
6,566,410 B1 5/2003 Zaki et al.
6,746,599 B2 6/2004 Cymerman et al.
6,800,116 B2 10/2004 Stevens et al.
7,152,851 B2 12/2006 Cincotta
7,357,857 B2 4/2008 Hart et al.
7,690,445 B2 4/2010 Perez-Cordova
7,749,378 B2 7/2010 Iqbal et al.
7,820,031 B2 10/2010 D'Alessandro et al.
7,909,989 B2 3/2011 Duyvesteyn et al.
7,934,549 B2 5/2011 Cimolai
8,133,316 B2 3/2012 Poncelet et al.
8,141,636 B2 3/2012 Speirs et al.
8,147,682 B2 4/2012 Lahaie et al.
8,157,003 B2 4/2012 Hackett et al.
8,252,107 B2 8/2012 Esmaeili et al.
8,261,831 B2 9/2012 Lockhart et al.
8,262,865 B2 9/2012 Sharma et al.
8,312,928 B2 11/2012 Lockhart et al.
8,343,337 B2 1/2013 Moffett et al.
8,354,020 B2 1/2013 Sharma et al.
8,357,291 B2 1/2013 Sury et al.
8,382,976 B2 2/2013 Moran et al.
8,394,180 B2 3/2013 Diaz et al.
8,449,764 B2 5/2013 Chakrabarty et al.
8,454,821 B2 6/2013 Chakrabarty et al.
8,455,405 B2 6/2013 Chakrabarty
8,550,258 B2 10/2013 Bara et al.
8,585,891 B2 11/2013 Lourenco et al.
2002/0043579 A1 4/2002 Scheybeler
2003/0089636 A1 5/2003 Marchionna et al.
2004/0074845 A1 4/2004 Hagino et al.
2005/0150844 A1 7/2005 Hyndman et al.
2006/0065869 A1 3/2006 Chipman et al.
2006/0138055 A1 6/2006 Garner et al.
2006/0196812 A1 9/2006 Beetge et al.
2008/0000810 A1 1/2008 Garner et al.
2008/0210602 A1 9/2008 Duyvesteyn
2009/0134059 A1 5/2009 Myers et al.

(56) References Cited

U.S. PATENT DOCUMENTS

| | | | |
|---|---|---|---|
| 2009/0200210 | A1 | 8/2009 | Hommema |
| 2009/0200688 | A1 | 8/2009 | Cincotta |
| 2009/0294328 | A1 | 12/2009 | Iqbal |
| 2010/0076236 | A1 | 3/2010 | Van Heuzen et al. |
| 2010/0089800 | A1 | 4/2010 | MacDonald et al. |
| 2010/0096297 | A1 | 4/2010 | Stevens et al. |
| 2010/0126395 | A1 | 5/2010 | Gauthier |
| 2010/0126906 | A1 | 5/2010 | Sury |
| 2010/0133149 | A1 | 6/2010 | O'Connor et al. |
| 2010/0147516 | A1 | 6/2010 | Betzer-Zilevitch |
| 2010/0155293 | A1 | 6/2010 | Verstraete et al. |
| 2010/0155304 | A1 | 6/2010 | Ding et al. |
| 2010/0206772 | A1 | 8/2010 | Keppers |
| 2010/0243534 | A1 | 9/2010 | Ng et al. |
| 2010/0258477 | A1 | 10/2010 | Kukkonen et al. |
| 2010/0258478 | A1 | 10/2010 | Moran et al. |
| 2010/0264068 | A1 | 10/2010 | Ikebe et al. |
| 2010/0276341 | A1 | 11/2010 | Speirs et al. |
| 2010/0276983 | A1 | 11/2010 | Dunn et al. |
| 2010/0282642 | A1 | 11/2010 | Kan |
| 2010/0298173 | A1 | 11/2010 | Smith et al. |
| 2010/0320133 | A1 | 12/2010 | Page et al. |
| 2011/0005750 | A1 | 1/2011 | Boerseth et al. |
| 2011/0011769 | A1 | 1/2011 | Sutton et al. |
| 2011/0061610 | A1 | 3/2011 | Speirs et al. |
| 2011/0089013 | A1 | 4/2011 | Sakurai et al. |
| 2011/0127197 | A1 | 6/2011 | Blackbourn et al. |
| 2011/0146164 | A1 | 6/2011 | Haney et al. |
| 2011/0174683 | A1 | 7/2011 | Cui et al. |
| 2011/0219680 | A1 | 9/2011 | Wilkomirsky Fuica |
| 2011/0233115 | A1 | 9/2011 | Moran et al. |
| 2011/0265558 | A1 | 11/2011 | Feimer et al. |
| 2011/0284428 | A1 | 11/2011 | Adeyinka et al. |
| 2012/0000830 | A1 | 1/2012 | Monaghan et al. |
| 2012/0000831 | A1 | 1/2012 | Moran et al. |
| 2012/0029259 | A1 | 2/2012 | McFarlane et al. |
| 2012/0043178 | A1 | 2/2012 | Kan |
| 2012/0074044 | A1 | 3/2012 | McFarlane |
| 2012/0074045 | A1 | 3/2012 | Stauffer et al. |
| 2012/0217187 | A1 | 8/2012 | Sharma et al. |
| 2012/0288419 | A1 | 11/2012 | Esmaeili et al. |
| 2013/0043165 | A1 | 2/2013 | Revington et al. |
| 2013/0081298 | A1 | 4/2013 | Bugg et al. |
| 2013/0140249 | A1 | 6/2013 | Sury et al. |
| 2013/0168294 | A1 | 7/2013 | Chakrabarty et al. |
| 2013/0313886 | A1 | 11/2013 | Van Der Merwe et al. |
| 2013/0345485 | A1 | 12/2013 | Duerr et al. |
| 2014/0001101 | A1 | 1/2014 | Van Der Merwe et al. |
| 2014/0011147 | A1 | 1/2014 | Van Der Merwe |
| 2014/0048408 | A1 | 2/2014 | Van Der Merwe et al. |
| 2014/0048450 | A1 | 2/2014 | Van Der Merwe et al. |
| 2014/0076785 | A1 | 3/2014 | Penner et al. |
| 2014/0083911 | A1 | 3/2014 | Van Der Merwe et al. |

FOREIGN PATENT DOCUMENTS

| | | | |
|---|---|---|---|
| CA | 1027501 | A1 | 3/1978 |
| CA | 1059052 | A1 | 7/1979 |
| CA | 1072474 | A1 | 2/1980 |
| CA | 1081641 | A1 | 7/1980 |
| CA | 1111782 | A1 | 11/1981 |
| CA | 1165712 | A1 | 4/1984 |
| CA | 1237689 | A1 | 6/1988 |
| CA | 1245990 | A1 | 12/1988 |
| CA | 1249414 | A1 | 1/1989 |
| CA | 1263331 | A1 | 11/1989 |
| CA | 1267860 | A1 | 4/1990 |
| CA | 1272975 | A1 | 8/1990 |
| CA | 2012305 | A1 | 9/1990 |
| CA | 2029795 | A1 | 5/1991 |
| CA | 1291957 | C | 11/1991 |
| CA | 1293465 | C | 12/1991 |
| CA | 2021185 | A1 | 1/1992 |
| CA | 2053016 | A1 | 5/1992 |
| CA | 2053086 | A1 | 4/1993 |
| CA | 2055213 | A1 | 5/1993 |
| CA | 2075108 | A1 | 1/1994 |
| CA | 2098656 | A1 | 12/1994 |
| CA | 2123076 | A1 | 11/1995 |
| CA | 2165865 | A1 | 6/1997 |
| CA | 2188064 | A1 | 4/1998 |
| CA | 2191517 | A1 | 5/1998 |
| CA | 2200899 | A1 | 9/1998 |
| CA | 2232929 | A1 | 9/1998 |
| CA | 2149737 | C | 3/1999 |
| CA | 2217300 | A1 | 3/1999 |
| CA | 2254048 | A1 | 5/1999 |
| CA | 2195604 | C | 11/1999 |
| CA | 2350907 | A1 | 5/2000 |
| CA | 2272045 | A1 | 11/2000 |
| CA | 2304972 | A1 | 10/2001 |
| CA | 2350001 | A1 | 12/2002 |
| CA | 2353109 | A1 | 1/2003 |
| CA | 2387257 | A1 | 11/2003 |
| CA | 2425840 | A1 | 10/2004 |
| CA | 2454942 | A1 | 7/2005 |
| CA | 2455011 | A1 | 7/2005 |
| CA | 2726122 | A1 | 7/2005 |
| CA | 2750837 | A1 | 7/2005 |
| CA | 2750845 | A1 | 7/2005 |
| CA | 2750934 | A1 | 7/2005 |
| CA | 2750936 | A1 | 7/2005 |
| CA | 2750939 | A1 | 7/2005 |
| CA | 2750995 | A1 | 7/2005 |
| CA | 2751587 | A1 | 7/2005 |
| CA | 2751773 | A1 | 7/2005 |
| CA | 2799354 | A1 | 7/2005 |
| CA | 2799400 | A1 | 7/2005 |
| CA | 2799739 | A1 | 7/2005 |
| CA | 2520943 | A1 | 4/2006 |
| CA | 2490734 | A1 | 6/2006 |
| CA | 2502329 | A1 | 9/2006 |
| CA | 2521248 | A1 | 3/2007 |
| CA | 2524110 | A1 | 4/2007 |
| CA | 2526336 | A1 | 5/2007 |
| CA | 2567185 | A1 | 4/2008 |
| CA | 2610122 | A1 | 5/2008 |
| CA | 2610124 | A1 | 5/2008 |
| CA | 2573633 | A1 | 7/2008 |
| CA | 2673961 | A1 | 7/2008 |
| CA | 2582059 | A1 | 9/2008 |
| CA | 2588043 | A1 | 11/2008 |
| CA | 2606312 | A1 | 4/2009 |
| CA | 2616036 | A1 | 6/2009 |
| CA | 2654611 | A1 | 8/2009 |
| CA | 2630392 | A1 | 11/2009 |
| CA | 2669059 | A1 | 12/2009 |
| CA | 2638120 | A1 | 1/2010 |
| CA | 2673981 | A1 | 1/2010 |
| CA | 2673982 | A1 | 1/2010 |
| CA | 2641294 | A1 | 4/2010 |
| CA | 2655852 | A1 | 4/2010 |
| CA | 2683374 | A1 | 4/2010 |
| CA | 2643893 | A1 | 5/2010 |
| CA | 2647855 | A1 | 7/2010 |
| CA | 2649928 | A1 | 7/2010 |
| CA | 2652355 | A1 | 8/2010 |
| CA | 2653032 | A1 | 8/2010 |
| CA | 2653058 | A1 | 8/2010 |
| CA | 2689684 | A1 | 8/2010 |
| CA | 2657360 | A1 | 9/2010 |
| CA | 2657801 | A1 | 10/2010 |
| CA | 2661579 | A1 | 10/2010 |
| CA | 2711136 | A1 | 10/2010 |
| CA | 2666025 | A1 | 11/2010 |
| CA | 2708416 | A1 | 12/2010 |
| CA | 2674246 | A1 | 1/2011 |
| CA | 2708048 | A1 | 1/2011 |
| CA | 2678818 | A1 | 3/2011 |
| CA | 2701317 | A1 | 3/2011 |
| CA | 2717406 | A1 | 4/2011 |
| CA | 2729457 | A1 | 7/2011 |
| CA | 2733862 | A1 | 7/2011 |

(56) References Cited

FOREIGN PATENT DOCUMENTS

| | | | |
|---|---|---|---|
| CA | 2705055 | A1 | 11/2011 |
| CA | 2768852 | A1 | 11/2011 |
| CA | 2748477 | A1 | 3/2012 |
| CA | 2752558 | A1 | 3/2012 |
| CA | 2730467 | A1 | 8/2012 |
| CA | 2735311 | A1 | 9/2012 |
| CA | 2740935 | | 11/2012 |
| CA | 2610052 | C | 2/2013 |
| CN | 1187300 | A | 7/1998 |
| EP | 0059106 | A2 | 9/1982 |
| GB | 2044796 | A | 10/1980 |
| GB | 2145730 | A | 4/1985 |
| JP | S56150407 | A | 11/1981 |
| JP | S57200402 | A | 12/1982 |
| JP | S6285415 | U | 5/1987 |
| RU | 2065455 | C1 | 8/1996 |
| RU | 2078095 | C1 | 4/1997 |
| RU | 2096438 | C1 | 11/1997 |
| WO | 2007102819 | A1 | 9/2007 |
| WO | 2009111871 | A1 | 9/2009 |
| WO | 2010088388 | A1 | 8/2010 |

OTHER PUBLICATIONS

Mitchell et al. "The solubility of asphaltenes in hydrocarbon solvents" Fuel, 1973, N. 02, vol. 52, p. 149-152.

Kemp, "Pinch Analysis and Process Integration, A User Guide on Process Integration for the Efficient Use of Energy", Second edition, Elsevier 2007.

Svreck et al "Successfully Specify Three-Phase Separators" Chemical Engineering Progress, Sep. 1994, p. 29-40.

Svreck et al. "Design Two-Phase Separators within the Right Limits" Chemical Engineering Progress, Oct. 1993, p. 53-60.

Fu et al."New technique for determination of diffusivities of volatile hydrocarbons in semi-solid bitumen", Fuel, 1979, vol. 58, August, pp. 557-560.

Kamoun et al."High Speed Shadowgraphy Investigations of Superheated Liquid Jet Atomization", ILASS-Americas 22nd Annual Conference on Liquid Atomization and Spray Systems, Cincinnati Ohio, May 2010.

Duan et al.'s "Numerical Analyses of Flashing Jet Structure and Droplet Size Characteristics"Journal of Nuclear Science and Technology, 2006, vol. 43, No. 3, p. 285-294.

Sou et al., "Effects of Cavitation in a Nozzle on liquid Jet atomization" International Journal of Heat and Mass Transfer; vol. 50, p. 3575-3582, 2007.

Ransom et al., "The relaps choke flow model and application to a large scale flow test", The American Society of Mechanical Engineers, Heat Transfer Division, 1980, Saratoga, New York.

Power,"Froth Treatment: Past, Present &Future" Oil Sand Symposium, University of Alberta, May 3-5, 2004.

Rahmani, "Shear-Induced Growth of Asphaltene Aggregates" Oil Sand Symposium, University of Alberta, May 4, 2004.

Paul et al. "Handbook of Industrial Mixing: Science and Practice" Wiley Interscience 2004, p. 391-477.

Blevins "Applied fluid dynamics handbook", Van Nostrand Reinhold Company 1984, p. 80-83.

Wu et al., "Experimental study on steam plume and temperature distribution for sonic jet" J. Phys.: Conf.Ser. 147 2009, 012079.

Yeon et al., "An Experimental Investigation of Direct Condensation of Steam Jet in Subcooled Water" Journal of Korean Nuclear Society vol. 29, No. 1, pp. 45-57, Feb. 1997.

Long et al., "Structure of water/solids/asphaltenes aggregates and effect of mixing temperature on settling rate in solvent-diluted bitumen" Fuel 2004, vol. 83, p. 823-832.

Rahimi et al., "Partial Upgrading of Athabasca Bitumen Froth by Asphaltene Removal", Unitar International Conference on Heavy Crude and Tar Sands, No. 1998.074, p. 1-8.

Hoehenberger, "Water Treatment, Cycle Chemistry, Boiler Operation and Related Problems/Failures on Steam Generator Systems > 30 bar", TÜV SÜD Industry Services, 2006, p. 1-14.

Schroyer, "Understand the Basics of Steam Injection Heating", Chemical Engineering Progress, Hydro-Thermal Corporation, May 1997, p. 1-4.

Prosonix, "PSX Steam Jet Diffuser . . . Technology That Makes a Difference", PSX Jet Diffuser 20110209.

Prosonix, "ProSonix Technical Bulletin", TB-4 Liquid & Steam Pressure Relationship.

Prosonix, "PSX Technical Bulletin", TB-7 Internally Modulated Steam Control 0210.

Prosonix, "Sparging Efficiency vs. Direct Steam Injection", TB-6 Sparging Efficiency & Performance 20101210.

Siemens, "Pictures of the Future", Spring 2006, Power Plants—Siemens Global Website, http://www.siemens.com/innovation/en/publikationen/publications_pof/pof_spring_2006/infrastructures_articles/power_plants.htm.

George, "Mining for Oil", Scientific American, Mar. 1998, p. 84-85.

Speight, "Deasphalting and Dewaxing Processes", The Chemistry and Technology of Petroleum, Fourth Edition, Chapter 19, CRC Press 2006.

Jeribi et al., "Adsorption Kinetics of Asphaltenes at Liquid Interfaces", Journal of Colloid and Interface Science, vol. 256, Issue 2, Dec. 15, 2002, pp. 268-272.

Branan, "Pocket Guide to Chemical Engineering" Elsevier Science & Technology Books, Nov. 1999.

Perry, "Perry's Chemical Engineers' Handbook" (7th Ed.), 1997.

Clarke et al., "Asphaltenes precipitation from Cold Lake and Athabasca bitumens", Petroleum Science and Technology, 1998, 16:3-4, p. 287-305.

Al-Atar, "Effect of Oil Compatibility and Resins/Asphaltenes Ratio on Heat Exchanger Fouling of Mixtures Containing Heavy Oil", Master Degree Thesis report, The University of British Columbia, Feb. 2000.

Gearhart, "ROSE® process offers energy savings for solvent extraction", Proceedings from the Fifth Industrial Energy Technology Conference vol. II, Houston, TX, Apr. 17-20, 1983, p. 823-835.

Clarke et al., "Asphaltene precipitation: detection using heat transfer analysis, and inhibition using chemical additives" Fuel, vol. 78, Issue 7, May 1997, p. 607-614.

Shell Canada Limited, Application for Approval of the Jackpine Mine—Phase 1, ERCB application No. 1271285, May 2002.

Imperial Oil Ressources Ventures Limited, Application for the Imperial Oil Resources Ventures Limited (Imperial Oil) and ExxonMobil Canada Properties (ExxonMobil Canada) Kearl Oil Sands Project—Mine Development (Kearl Project), ERCB Application No. 1408771, Jul. 12, 2005.

Shell Canada Limited, Application for the Approval of Muskeg River Mine Project, ERCB Application No. 970588, Dec. 19, 1997.

Beckman Coulter, Particle Size and Size Distribution Analysis, Coulter Counter.com, pp. 1-3.

Outokumpu Technology, Slurry particle size analyzer, PSI 200 TM, 2006, pp. 1-8.

Johnson, Particle size distribution in clays, Clays and Clay Minerals, pp. 89-91.

Buckley et al., Solubility of the Least-Soluble Asphaltenes, Asphaltenes, Heavy Oils, and Petroleomics, Springer, 2007, Chapter 16, pp. 401-437.

Gerson et al., The Relation of Surfactant Properties to the Extraction of Bitumen from Athabasca Tar Sand by a Solvent-Aqueous-Surfactant Process, Chemistry for Energy, American Chemical Society, 1979, Chapter 6, pp. 66-79.

Nour et al., Characterization and Demulsification of Water-in-crude Oil Emulsions, Journal of Applied Sciences, vol. 7, issue 10, 2007, pp. 1437-1441.

Malcolmson et al., In-Line Particle Size Measurements for Cement and Other Abrasive Process Environments, for Presentation at the IEEE/PCA 40th Cement Industry Technical Conference, 1998, pp. 1-13.

(56) References Cited

OTHER PUBLICATIONS

Bui et al., "Modelling of Viscous Resuspension Using a One-Field Description of Multiphase Flows", Third International Conference on CFD in the Minerals and Process Industries, 2003 pp. 265-268.
Dispersion Technology, Inc., "Model DT-1201 . . . Acoustic and electro-acoustic spectrometer", Particle size and zeta potential measurement.
Csiro Minerals, UltraPS—Ultrasonic Particle Size Analyser, www.minerals.csiro.au.
Wedd, "Determination of Particle Size Distributions Using Laser Diffraction", Educ.Reso. for Part. Techn. 032Q-Wedd, pp. 1-4.
Rahmani et al., "Settling Properties of of Asphaltene Aggregates", Abstract, Energy Fuels, 2005, 19 (3), pp. 1099-1108.
Rahmani et al., "Fractal structure of asphaltene aggregates", Abstract, Journal of Colloid and Interface Science, vol. 285, Issue 2, May 15, 2005, pp. 599-608.
A John Brooks Website, Spraying pumping filtering, Automated Retractable Nozzle System, FluidHandlingSolutions.com.
Liang et al., "Experimental and Analytical Study of Direct Contact Condensation of Steam in Water" Nucl. Eng. Des., 147, Issue 3, Apr. 1994, pp. 425-435.
Peramanu et al., "Flow loop apparatus to study the effect of solvent, temperature and additives on asphaltene precipitation" Journal of Petroleum Science and Engineering, vol. 23, Issue 2, Aug. 1999, pp. 133-143.

* cited by examiner

HEAT RECOVERY FOR BITUMEN FROTH TREATMENT PLANT INTEGRATION WITH SEALED CLOSED-LOOP COOLING CIRCUIT

This application is a National Stage Application of International Application No. PCT/CA2012/050186, filed Mar. 27, 2012, entitled "HEAT RECOVERY FOR BITUMEN FROTH TREATMENT PLANT INTEGRATION WITH SEALED CLOSED-LOOP COOLING CIRCUIT" which claims priority to Canadian Patent Application No. 2737410, filed on Apr. 15, 2011, entitled, "Heat Recovery For Bitumen Froth Treatment Plant Integration With Sealed Closed-Loop Cooling Circuit", which is incorporated herein by reference in its entirety.

FIELD OF THE INVENTION

The present invention generally relates to the field of oil sands processing and in particular relates to heat exchange and recovery for bitumen froth treatment plants.

BACKGROUND

Known cooling systems in oil sands froth treatment process included open loop once-through cooling systems and conventional closed cooling water loop systems where process exchangers transfer heat to circulating cooling water which then recovers with heat exchangers higher grade heat to a recycling process water stream and then removes the low grade heat by evaporative cooling in a cooling tower.

Open loop cooling systems that transfer process heat directly have poor energy efficiency and are not environmentally acceptable. Within oil sand operations, bitumen extraction process requires significant volumes of hot process water at or around 80° C., some of the heat being largely recovered for recycling at temperatures ranging between 4° C. to 30° C. depending on factors such as season and pond size. This recycle water contains suspended solids, hydrocarbon e.g. bitumen, various salts e.g. chlorides and minerals that cycle up over time to reflect connate water contaminates in the ore body, and as exposed to atmosphere the water is saturated with both oxygen and carbon dioxide gases. Various oil sands operators have used this recycle water stream as cooling water with costly repercussions and drawbacks including: frequent need to clean fouled exchangers and to permit continuous exchanger cleaning have spare exchangers installed; upgrading of metallurgy to combat erosion and corrosion particularly in situations where the process cooling temperatures are above 60° C.; frequent need to maintain exchanger velocities to control fouling; piping repairs on an on-going basis due to erosion and corrosion due to oxygen, chlorides and temperatures; and temperature limitations forcing supplementary heating of process water for extraction operations.

Oil sand operators have also used some conventional close loop cooling systems using cooling towers to reject heat by evaporative cooling with make-up water from the river. This option is not without challenges. For instance, the evaporative process causes minerals in make-up water to cycle up to saturation levels which if not managed will foul exchangers. The management involves blow down and make-up inventories together with chemical anti-scaling programs. Despite this water treatment and management, maximum cooling water temperatures are limited to levels similar to recycle water at about 65° C. In addition, the location of the cooling tower can create significant fog and ice safety issues. Consequently, towers are generally placed a significant distances from process unit and the interconnect supply and return pipelines are relatively costly and also often have diameters from 24-60 inches. Furthermore, the heat lost by evaporative cooling is not available for process use. In addition, blow down with concentrated minerals are disposed in tailing systems. Divalent ions, such as calcium ions, adversely affect bitumen extraction if not precipitated by carbon dioxide.

In addition, integrating froth treatment plant with other oil sands process operations in fraught with challenges due to differing operational and upset conditions.

In summary, known practices and techniques for heat exchange and cooling in this field experience various drawbacks and inefficiencies, and there is indeed a need for a technology that overcomes at least some of those drawbacks and inefficiencies.

SUMMARY OF THE INVENTION

The present invention responds to the above-mentioned need by providing a process and a system for heat removal and recovery from a froth treatment plant.

In one embodiment, the invention provides a system for recovering heat from a bitumen froth treatment plant. The system comprises a heat removal exchanger associated with the bitumen froth treatment plant and receiving a hot froth treatment process stream; a heat recovery exchanger; and a sealed closed-loop heat transfer circuit. The sealed closed-loop heat transfer circuit comprises piping for circulating a heat exchange media having uncontaminated and low fouling properties. The piping comprises a supply line for providing the heat exchange media to the heat removal exchanger to remove heat from the hot froth treatment process stream and produce a heated media; and a return line for providing the heated media from the heat removal exchanger to the heat recovery exchanger. The sealed closed-loop heat transfer circuit also comprises a pump for pressurizing and pumping the heat exchange media through the piping; and a pressure regulator in fluid communication with the piping for regulating pressure of the heat exchange media. The pump and the pressure regulator are configured to maintain the heat exchange media under pressure and in liquid phase within the piping. The system also comprises an oil sands process fluid line for supplying an oil sands process fluid to the heat recovery exchanger to allow the heated media to heat the oil sands process fluid, thereby producing a heated oil sands process fluid and a cooled heat exchange media for reuse in the heat removal exchanger.

In one aspect, the heat exchange media comprises demineralized water.

In another aspect, the heat exchange media comprises chemical additives to reduce fouling.

In another aspect, the heat exchange media is selected to avoid dissolved oxygen, suspended solids, scaling compounds and hydrocarbon contaminants therein.

In another aspect, the heat removal exchanger comprises a solvent condenser and the hot froth treatment process stream comprises a vapour phase solvent.

In another aspect, the solvent condenser comprises a plurality of solvent condensers.

In another aspect, the solvent condenser is associated with a solvent recovery unit.

In another aspect, the solvent condenser is configured such that the vapour phase solvent is condensed at a condensation temperature between about 65° C. and about 130° C.

In another aspect, the solvent condenser is configured such that the heat exchange media is heated from an inlet temperature between about 25° C. and about 40° C. to an outlet temperature between about 80° C. and about 120° C.

In another aspect, the heat recovery exchanger comprises a plurality of heat recovery exchangers.

In another aspect, the plurality of heat recovery exchangers comprises a first array of heat recovery exchangers arranged in series and a second array of heat recovery exchangers arranged in series.

In another aspect, the first and second arrays are arranged in parallel to each other.

In another aspect, the heat recovery exchangers are shell-and-tube type heat exchangers comprising tubes receiving the oil sands process fluid and a shell receiving the heated media.

In another aspect, the system comprises an in-line exchanger cleaning system associated with the shell-and-tube type heat exchangers.

In another aspect, the sealed closed-loop heat transfer circuit comprises a control device for controlling the temperature of the cooled heat exchange media to be consistent for reuse in the heat removal exchanger.

In another aspect, the control device comprises a bypass line for bypassing the heat recovery exchangers.

In another aspect, the pressure regulator comprises an expansion device.

In another aspect, the expansion device comprises an expansion tank.

In another aspect, the expansion tank is in fluid communication with the supply line of the piping.

In another aspect, the expansion tank is connected to the supply line upstream of the pump and downstream of the heat recovery exchanger.

In another aspect, the system comprises a balance line for providing fluid communication between the piping and the expansion tank.

In another aspect, the pump and the pressure regulator are configured to maintain the pressure of the heat exchange media above the pressure of the hot froth treatment process stream.

In another aspect, the pump and the pressure regulator are configured to maintain the pressure of the heat exchange media at least about 10% above the pressure of the hot froth treatment process stream.

In another aspect, the pump and the pressure regulator are configured to maintain the pressure of the heat exchange media between about 300 kPaa and about 800 kPaa.

In another aspect, the system also has a second heat removal exchanger associated with the bitumen froth treatment plant and receiving a second froth treatment process stream that is cooler than the hot froth treatment process stream; a second heat recovery exchanger; and a second heat transfer circuit for circulating a cooling media to the second heat removal exchanger to remove heat from the second froth treatment process stream and produce a heated cooling media and providing the same to the second the heat recovery exchanger.

In another aspect, the second heat removal exchanger comprises a low temperature solvent condenser and the second froth treatment process stream comprises a vapour phase solvent.

In another aspect, the low temperature solvent condenser comprises a plurality of low temperature solvent condensers.

In another aspect, the low temperature solvent condenser is associated with a tailings solvent recovery unit.

In another aspect, the low temperature solvent condenser is configured such that the vapour phase solvent is condensed at a condensation temperature between about 60° C. and about 80° C.

In another aspect, the low temperature solvent condenser is configured such that the cooling media is heated from an inlet temperature between about 4° C. and about 30° C. to an outlet temperature between about 40° C. and about 60° C.

In another aspect, the second heat recovery exchanger comprises a plurality of second heat recovery exchangers.

In another aspect, the plurality of second heat recovery exchangers comprises at least two in series.

In another aspect, the second heat recovery exchangers are shell-and-tube type heat exchangers comprising tubes receiving the oil sands process fluid and a shell receiving the heated cooling media.

In another aspect, the system comprises an in-line exchanger cleaning system associated with the shell-and-tube type heat exchangers.

In another aspect, the second heat recovery exchangers are plate and frame or spiral type heat exchangers.

In another aspect, the heat recovery exchanger and the second heat recovery exchanger are arranged in series to serially heat the oil sands process fluid.

In another aspect, the heat recovery exchanger and the second heat recovery exchanger are arranged in parallel for heating portions of the oil sands process fluid.

In another aspect, the system comprises a cooling tower coupled to the second heat transfer circuit for receiving the cooling media discharged from the second heat recovery exchanger and provide a cooled cooling media for reuse in the second heat removal exchanger.

In another aspect, the system comprises a sealed cooling tower coupled to the sealed closed-loop heat transfer circuit for trim cooling of the heat exchange media discharged from the heat recovery exchanger.

In another aspect, the sealed cooling tower comprises coiled tubing for carrying the heat exchange media and a cooling spray device for spraying cooling water into the coiled tubing to enable heat removal from the heat exchange media.

In another aspect, the sealed cooling tower is a WSAC™ cooling tower.

In another aspect, the system comprises a dump line in fluid communication with the oil sands process fluid line carrying the heated oil sands process fluid from the heat recovery exchangers, the dump line being configured to discard the heated oil sands process fluid.

In another aspect, the oil sands process fluid comprises recycle process water for reuse in an oil sands extraction operation.

In another aspect, the system comprises a trim heater for further heating the heated recycle process water prior to the oil sands extraction operation.

In another aspect, the froth treatment plant is a high temperature paraffinic froth treatment plant.

In another aspect, the high temperature paraffinic froth treatment plant is operated between about 70° C. and about 120° C.

In another aspect, the froth treatment plant is a naphthenic froth treatment plant The invention also provides a process for recovering heat from a bitumen froth treatment plant, the process comprising:

providing sealed closed-loop heat transfer circuit for circulating a heat exchange media having low fouling properties;

removing heat from a hot froth treatment stream into the heat exchange media to produce a heated media;

transferring heat from the heated media to an oil sands process fluid to produce a heated oil sands process fluid and a cooled heat exchange media; and pressurizing and regulating pressure of the heat exchange media within the sealed closed-loop heat transfer circuit to maintain the heat exchange media under pressure and in liquid phase.

In one aspect of the process, the heat exchange media comprises demineralized water.

In another aspect, the heat exchange media comprises chemical additives to reduce fouling.

In another aspect, the heat exchange media is selected to avoid dissolved oxygen, suspended solids, scaling compounds and hydrocarbon contaminants therein.

In another aspect, the step of removing heat comprises condensing a vapour phase solvent as the hot froth treatment stream in a solvent condenser.

In another aspect, the solvent condenser comprises a plurality of solvent condensers.

In another aspect, the solvent condenser is associated with a solvent recovery unit of the bitumen froth treatment plant.

In another aspect, the process comprises condensing the vapour phase solvent at a condensation temperature between about 65° C. and about 1130° C.

In another aspect, the process comprises heating the heat exchange media in the solvent condenser from an inlet temperature between about 25° C. and about 40° C. to an outlet temperature between about 80° C. and about 120° C.

In another aspect, the step of transferring heat comprises using a plurality of heat recovery exchangers.

In another aspect, the plurality of heat recovery exchangers comprises a first array of heat recovery exchangers arranged in series and a second array of heat recovery exchangers arranged in series.

In another aspect, the first and second arrays are arranged in parallel to each other.

In another aspect, the heat recovery exchangers are shell-and-tube type heat exchangers comprising tubes receiving the oil sands process fluid and a shell receiving the heated media.

In another aspect, the process comprises in-line cleaning of the shell-and-tube type heat exchangers.

In another aspect, the array of heat recovery exchangers comprises plate and frame or spiral type heat exchangers.

In another aspect, the process comprises controlling the temperature of the cooled heat exchange media to be consistent for reuse in the step of removing heat.

In another aspect, the controlling is performed by a control device comprising a bypass line for partially bypassing the step of recovering heat.

In another aspect, the step of pressurizing and regulating pressure is performed by a pump and a pressure regulator.

In another aspect, the pressure regulator comprises an expansion device.

In another aspect, the expansion device comprises an expansion tank.

In another aspect, the expansion tank is in fluid communication with the cooled heat exchange media in the sealed closed-loop heat transfer circuit.

In another aspect, the pressure of the heat exchange media is maintained above the pressure of the process stream.

In another aspect, the pressure of the heat exchange media is maintained at least 10% above the pressure of the process stream.

In another aspect, the pressure of the heat exchange media is maintained between about 300 kPaa and about 800 kPaa.

In another aspect, the process comprises providing a second heat transfer circuit for circulating a cooling media; removing heat from a second froth treatment process stream that is cooler than the hot froth treatment process stream into the cooling media; and transferring heat from the heated cooling media to the oil sands process fluid.

In another aspect, the step of removing heat comprises condensing a second vapour phase solvent as the second froth treatment stream in a low temperature solvent condenser.

In another aspect, the low temperature solvent condenser comprises a plurality of low temperature solvent condensers.

In another aspect, the low temperature solvent condenser is associated with a tailings solvent recovery unit of the bitumen froth treatment plant.

In another aspect, the vapour phase solvent is condensed at a condensation temperature between about 60° C. and about 80° C.

In another aspect, step of removing heat comprising heating the cooling media from an inlet temperature between about 4° C. and about 30° C. to an outlet temperature between about 40° C. and about 60° C.

In another aspect, the step of transferring heat from the heated cooling media is performed in a second heat recovery exchanger.

In another aspect, the second heat recovery exchanger is a shell-and-tube type heat exchanger comprising tubes receiving the oil sands process fluid and a shell receiving the heated cooling media.

In another aspect, the process comprises serially heating the oil sands process fluid via the heated media and the heated cooling media.

In another aspect, the process comprises heating portions of the oil sands process fluid respectively via the heated media and the heated cooling media in parallel.

In another aspect, the process comprises a cooling tower coupled to the second heat transfer circuit for receiving the cooling media and providing a cooled cooling media for reuse in the step of removing heat from the second froth treatment process.

In another aspect, the process comprises trim cooling the heat exchange media using a sealed cooling tower coupled to the sealed closed-loop heat transfer circuit.

In another aspect, the sealed cooling tower comprises coiled tubing for carrying the heat exchange media and a cooling spray device for spraying cooling water into the coiled tubing to enable heat removal from the heat exchange media.

In another aspect, the sealed cooling tower is a WSAC™ cooling tower.

In another aspect, the process comprises dumping the heated oil sands process fluid in response to upset conditions in downstream application of the heated oil sands process fluid.

In another aspect, the oil sands process fluid comprises recycle process water for reuse in an oil sands extraction operation.

In another aspect, the process comprises trim heating the heated recycle process water prior to the oil sands extraction operation.

In another aspect, the froth treatment plant is a high temperature paraffinic froth treatment plant.

In another aspect, the high temperature paraffinic froth treatment plant is operated between about 70° C. and about 120° C.

The invention also provides a system for recovering heat from a bitumen froth treatment plant. The system comprises a set of high temperature cooling exchangers associated with the bitumen froth treatment plant; a set of low temperature cooling exchangers associated with the bitumen froth treatment plant; a high temperature circulation loop for circulating heat exchange media for recovering heat from the set of high temperature cooling exchangers to produce a heated media; a low temperature circulation loop for circulating a cooling media for recovering heat from the set of low temperature cooling exchangers and producing a heated cooling media; and at least one oil sands process fluid line, each oil sands process fluid line in heat exchange connection with at least one of the high temperature circulation loop and the low temperature circulation loop, such that the heated media and the heated cooling media transfer heat to the corresponding one of the at least one the oil sands process fluid to produce a corresponding at least one heated process fluid.

In one aspect, one of the at least one oil sands process fluid line is in heat exchange connection with both the high temperature heat recovery circulation loop and the low temperature heat recovery circulation loop for receiving heat therefrom.

In another aspect, the system comprises a high temperature heat exchanger connected to the high temperature circulation loop and the oil sands process fluid line.

In another aspect, the high temperature heat exchanger is a high temperature shell-and-tube exchanger comprising tubes in fluid communication with the oil sands process fluid line and a shell in fluid communication with the high temperature circulation loop for receiving the heated media.

In another aspect, the system comprises an in-line exchanger cleaning system associated with the high temperature shell-and-tube heat exchanger.

In another aspect, the system comprises a low temperature heat exchanger connected to the low temperature heat recovery circulation loop and the oil sands process fluid line.

In another aspect, the low temperature heat exchanger is a low temperature shell-and-tube exchanger comprising tubes in fluid communication with the oil sands process fluid line and a shell in fluid communication with the low temperature heat recovery circulation loop for receiving the heated cooling media.

In another aspect, the system comprises an in-line exchanger cleaning system associated with the low temperature shell-and-tube type heat exchanger.

In another aspect, the low temperature heat exchanger and the high temperature heat exchanger are arranged in series for serially heating the oil sands process fluid.

In another aspect, the low temperature heat exchanger and the high temperature heat exchanger are arranged in parallel for heating portions of the oil sands process fluid.

In another aspect, the oil sands process fluid is recycle process water.

In another aspect, the system comprises a pipeline for supplying the heated recycle process water to an oil sands extraction operation.

In another aspect, the high temperature circulation loop is a sealed closed-loop circuit and comprises a pump and a pressure regulator for circulating the heat exchange media under pressure.

In another aspect, the pump and the pressure regulator are configured to maintain the pressure of the heat exchange media above the pressure of the hot froth treatment process stream.

In another aspect, the pump and the pressure regulator are configured to maintain the pressure of the heat exchange media at least about 10% above the pressure of the hot froth treatment process stream.

In another aspect, the pump and the pressure regulator are configured to maintain the pressure of the heat exchange media between about 300 kPaa and about 800 kPaa.

In another aspect, the heat exchange media comprises demineralized water.

In another aspect, the heat exchange media comprises chemical additives to reduce fouling.

In another aspect, the heat exchange media is selected to avoid dissolved oxygen, suspended solids, scaling compounds and bitumen therein.

In another aspect, the high temperature cooling exchangers comprise high temperature solvent condensers for condensing and removing heat from a vapour phase solvent.

In another aspect, the high temperature solvent condensers are associated with a solvent recovery unit of the bitumen froth treatment plant.

In another aspect, the high temperature solvent condensers are configured such that the vapour phase solvent is condensed at a condensation temperature between about 65° C. and about 130° C.

In another aspect, the high temperature solvent condensers are configured such that the heat exchange media is heated from an inlet temperature between about 25° C. and about 40° C. to an outlet temperature between about 80° C. and about 120° C.

In another aspect, the low temperature circulation loop is an open-loop circuit.

In another aspect, the cooling media comprises process water.

In another aspect, the low temperature circulation loop is a sealed closed-loop circuit.

In another aspect, the cooling media comprises demineralized water.

In another aspect, the cooling media comprises chemical additives to reduce fouling.

In another aspect, the cooling media is selected to avoid dissolved oxygen, suspended solids, scaling compounds and bitumen therein.

In another aspect, the set of high temperature cooling exchangers are associated with a froth separation unit (FSU), a solvent recovery unit (SRU) or a tailings solvent recovery unit (TSRU) or a combination thereof in the bitumen froth treatment plant.

In another aspect, the bitumen froth treatment plant is a high temperature paraffinic froth treatment plant.

In another aspect, the set of high temperature cooling exchangers are associated with the SRU.

In another aspect, the set of high temperature cooling exchangers are SRU solvent condensers.

The invention also provides a process for recovering heat from a bitumen froth treatment plant using a sets of high and low temperature cooling exchangers.

DETAILED DESCRIPTION

In one aspect of the present invention, as illustrated in FIGS. 1, 2, 5 and 6, a heat removal and recovery system is provided to remove heat from a bitumen froth treatment plant and reuse the heat in an oil sands process fluid such as process water which is heated for extraction operations.

It is noted that a bitumen froth treatment plant preferably includes a froth settling unit (FSU), a solvent recovery unit (SRU) and a tailings solvent recovery unit (TSRU). The FSU receives bitumen froth and after addition of diluent solvent, such as paraffinic or naphthenic solvent, the diluted froth is separated into a high diluted bitumen component and an underflow solvent diluted tailings component. Depending on the particular solvent, solvent-to-bitumen ratio (S/B) and operating conditions used in the FSU, the high diluted bitumen component and the solvent diluted tailings component will have certain compositions and characteristics. The high diluted bitumen component is further treated in the SRU to remove solvent from the bitumen and produce recovered solvent for reuse in the FSU and bitumen for upgrading. The solvent diluted tailings component is further treated in the TSRU to recover solvent for reuse in the FSU and produce a solvent recovered tailings component which is sent to tailings ponds or further processing, as the case may be. In the overall froth treatment plant, each of the froth treatment units may include a number of vessels, heat exchangers and other processing equipment which operate at various conditions depending on the design and operation of the plant. For instance, the FSU may include several sets of froth settling vessels arranged in series or in parallel or a combination of series and parallel. The heat from the bitumen froth treatment plant is removed from a so-called "hot froth treatment process stream" which should be considered as one or more of various different types of process streams that may be liquid, vapour, slurry or a mixture thereof; may contain various concentrations of solvent, hydrocarbons, water and/or mineral solids; may be associated with the FSU, SRU and/or TSRU; and may be in a naphthenic or paraffinic froth treatment plant.

Preferably, the froth treatment operation is a high temperature paraffinic froth treatment (PFT) process. The FSU preferably operates above about 70° C., and may be between about 70° C. and about 120° C., between about 70° C. and about 90° C., or between about 90° C. and about 120° C.

The froth treatment plant includes heat transfer devices to heat, cool or condense various process streams. In particular, the heat transfer devices include cooling or condensing devices for removing heat from process streams.

Figure 3:
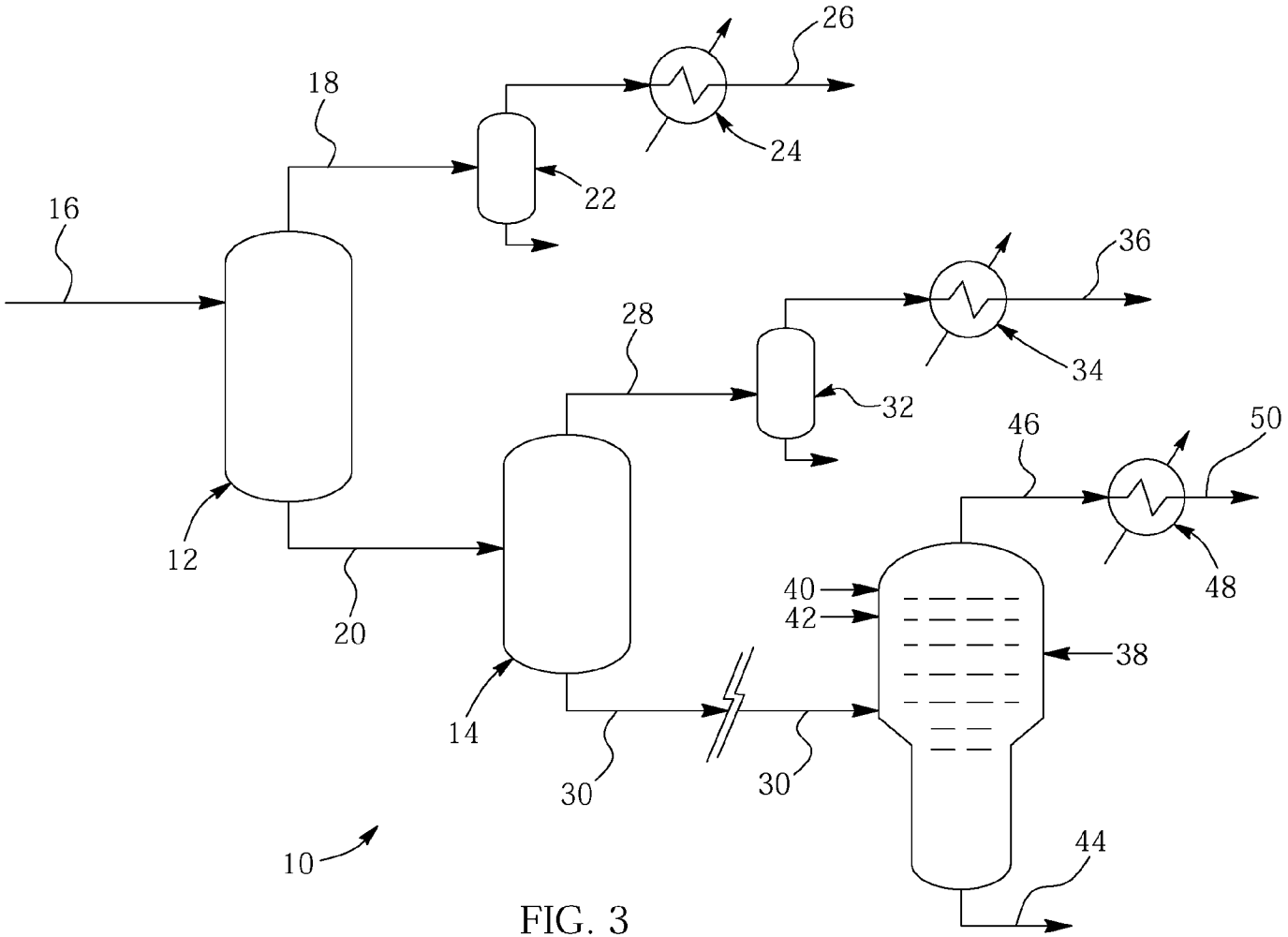
FIG. 3 is a process flow diagram of an SRU including an example of condensing heat exchangers for use in connection with some embodiments of the present invention.

Referring to FIG. 3, an SRU 10 may include one or more flash vessels 12, 14 for recovering solvent from high diluted bitumen 16 derived from the froth separation vessels. The first flash vessel 12 produces a flashed solvent stream 18 and a partially solvent recovered bitumen stream 20. The flashed solvent stream 18 passes through a separator 22 and then is condensed in a first solvent condenser 24 to produce condensed solvent 26. The partially solvent recovered bitumen stream 20 is subjected to a second flash in flash vessel 14 to produce a second flashed solvent 28 and solvent recovered bitumen 30. The second flashed solvent 28 may be sent to a separator 32 and then to a second condenser 34 to produce a second condensed solvent stream 36, which may be combined with the first solvent stream 26 and reused in the froth treatment operation. The solvent recovered bitumen 30 may be further processed, for example in a bitumen fractionation column 38, which may receive other streams 40, 42 recovered from the SRU. The bitumen fractionation column 38 generates hot dry bitumen 44 as well as an overhead solvent 46 which is preferably condensed in a column condenser 48 to produce column recovered condensed solvent 50.

Figure 4:
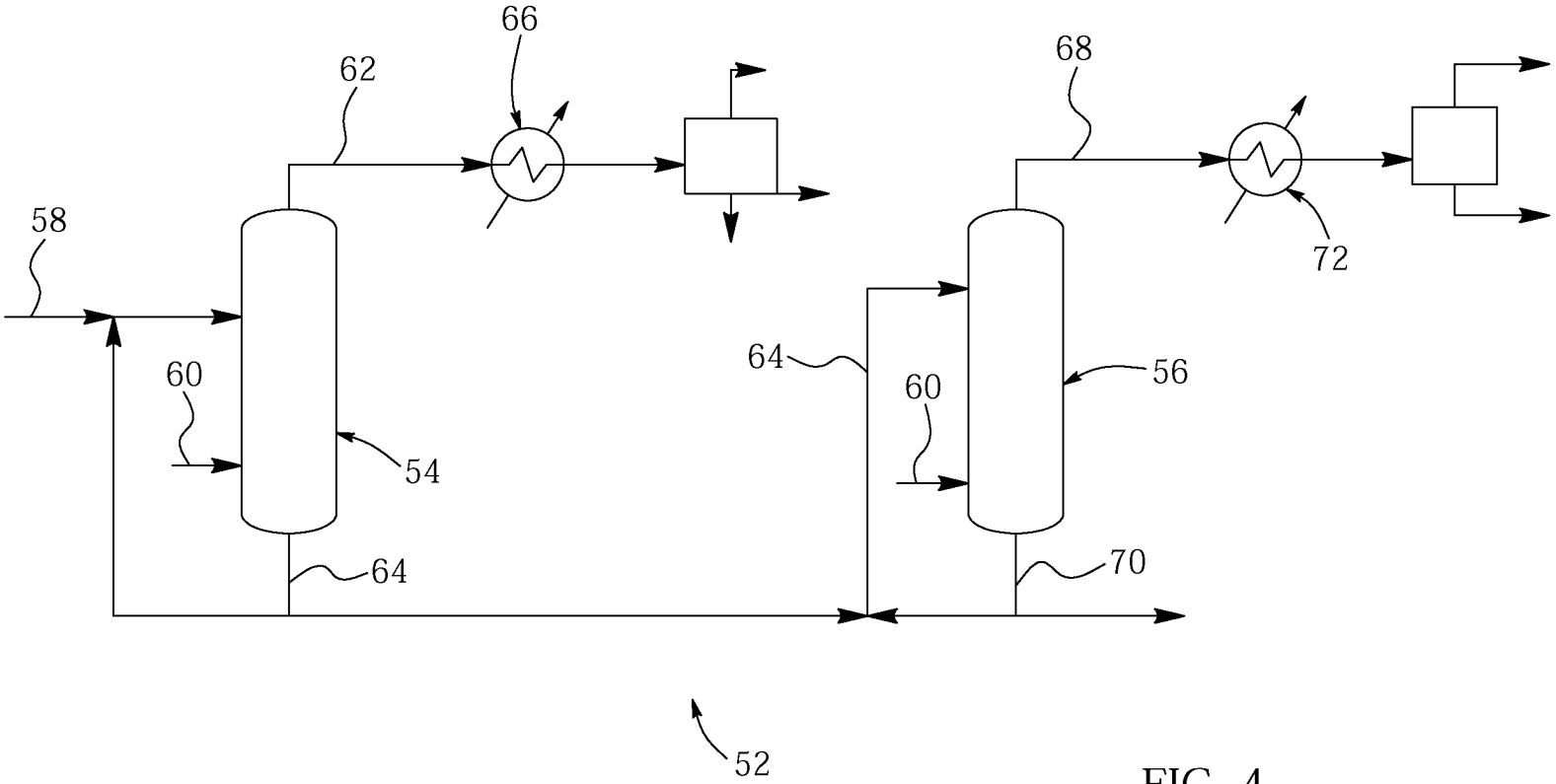
FIG. 4 is a process flow diagram of a TSRU including an example of condensing heat exchangers for use in connection with some embodiments of the present invention.
Figure 5A:
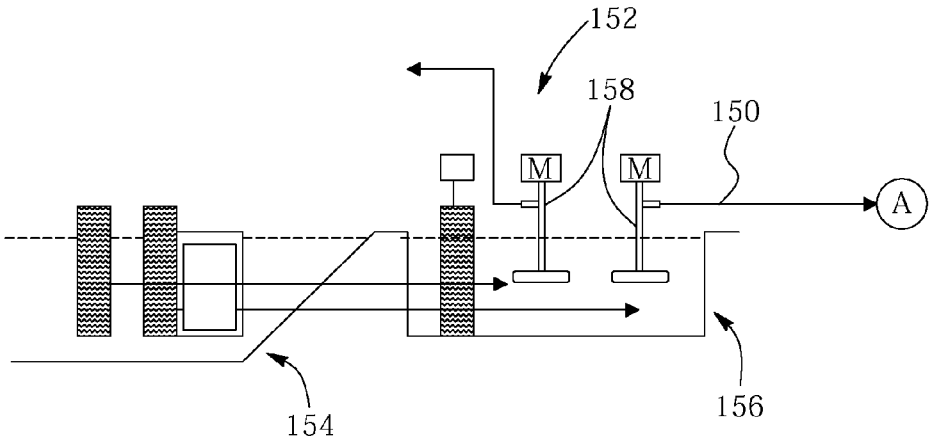
FIGS. 5A, 5B and 5C, collectively referred to herein as FIG. 5, is a process flow diagram of a heat removal and recovery system according to another embodiment of the present invention.
Figure 5A:
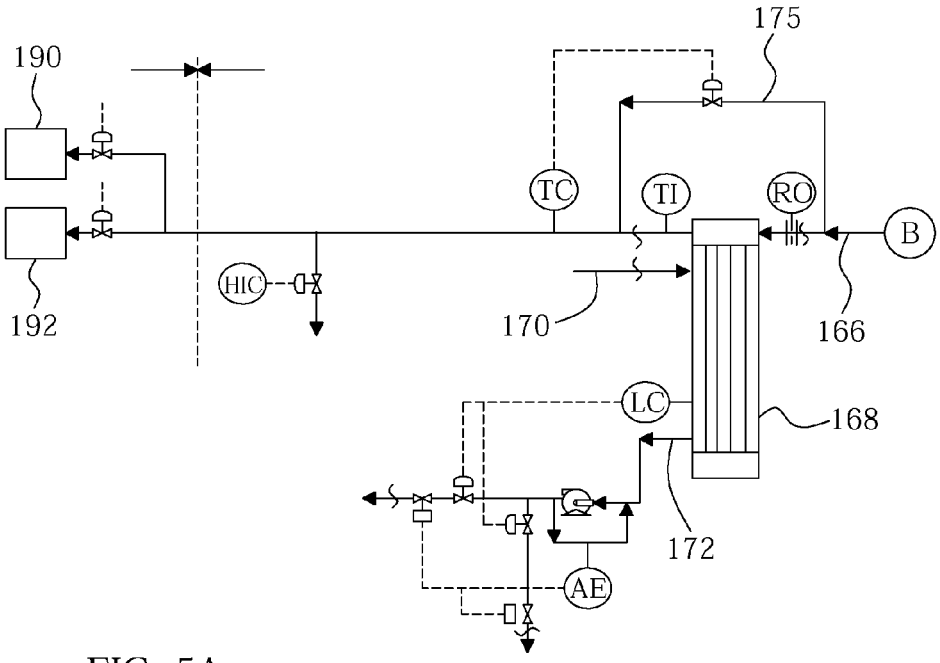
Figure 5B:
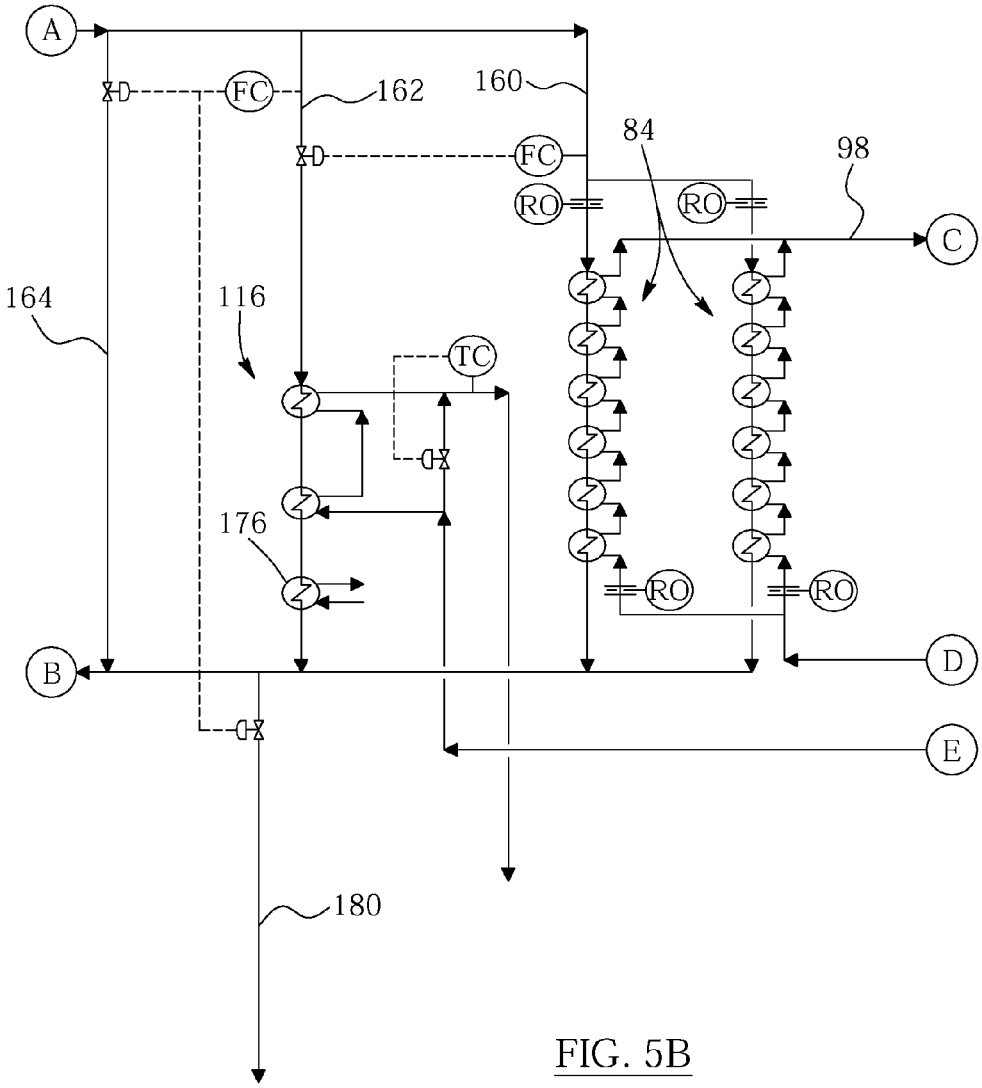
Figure 5C:
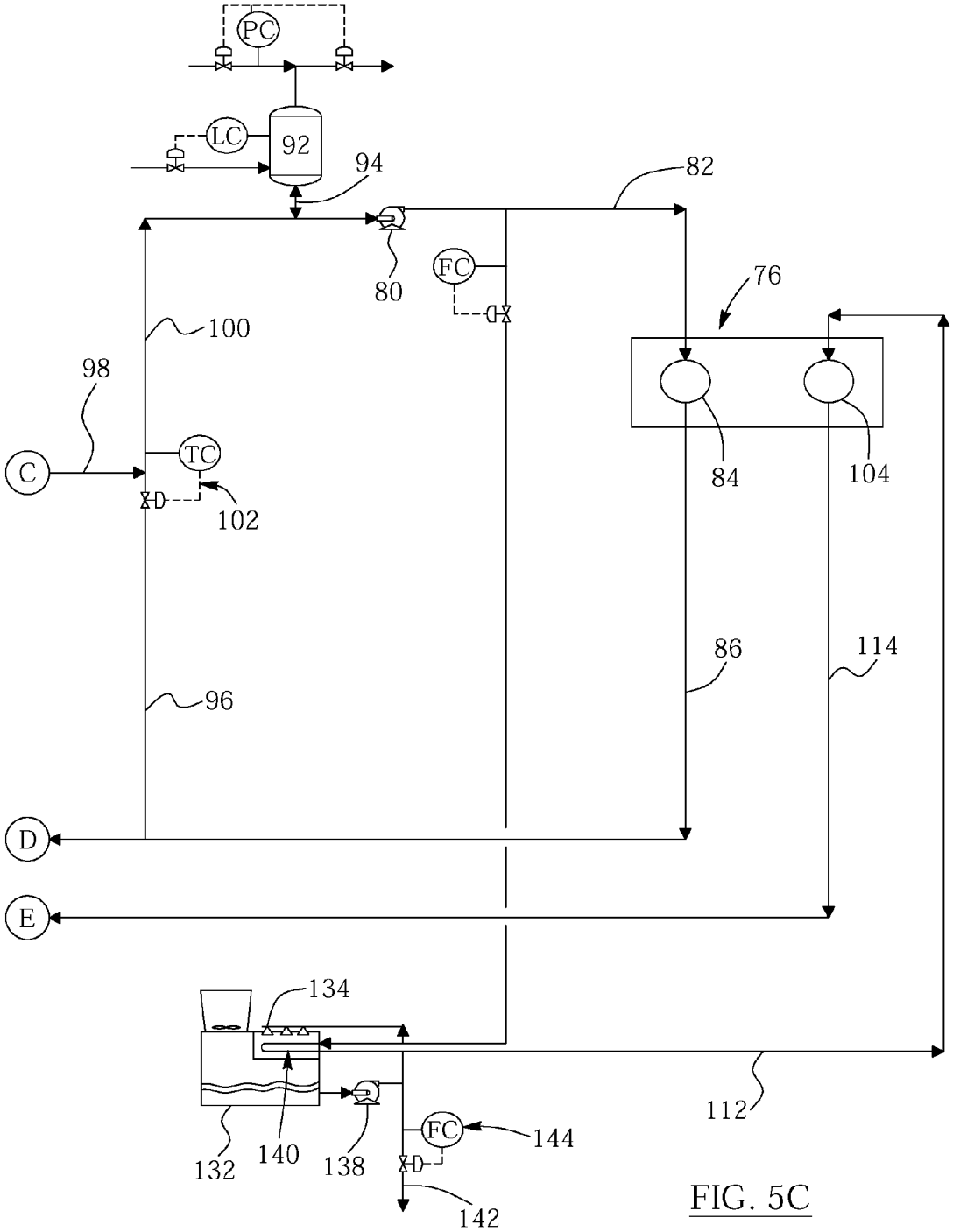
Figure 6A:
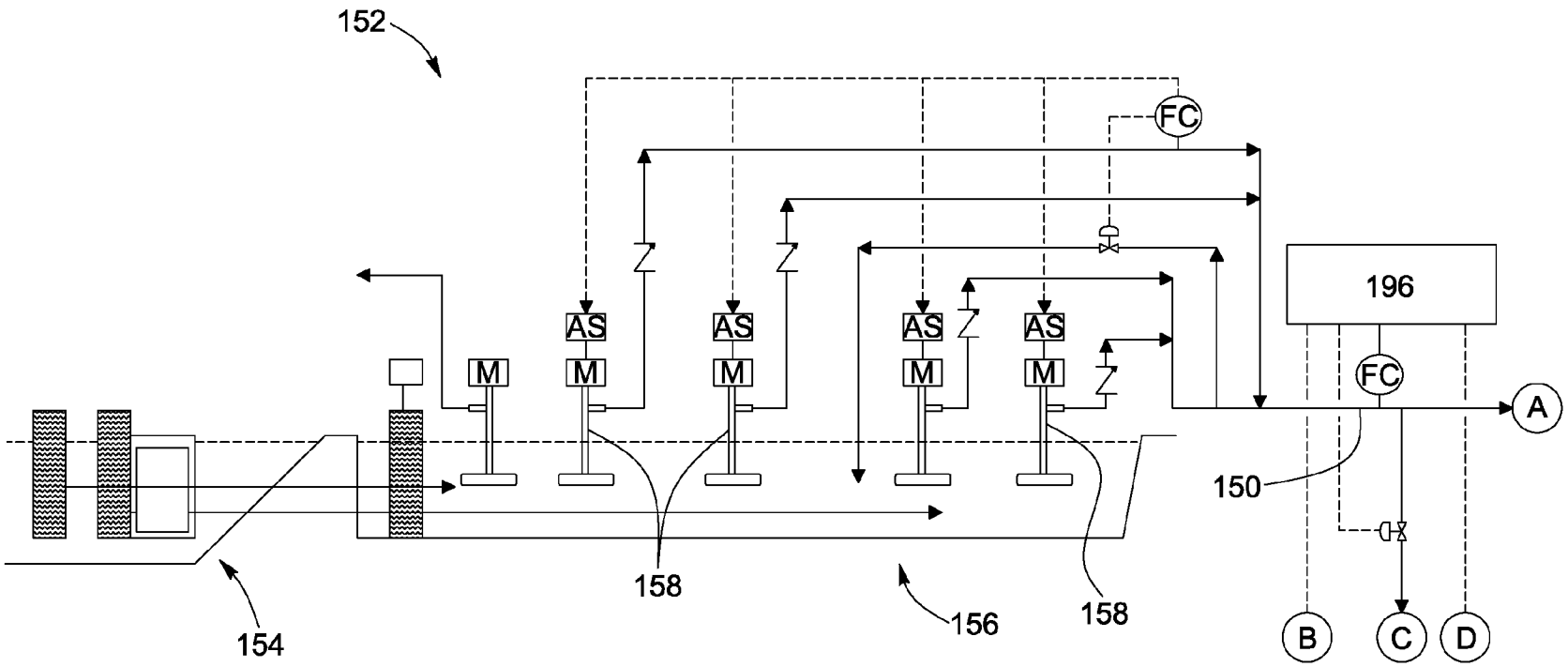
FIGS. 6A, 6B, 6C and 6D, collectively referred to herein as FIG. 6, is a process flow diagram of a heat removal and recovery system according to another embodiment of the present invention.
Figure 6B:
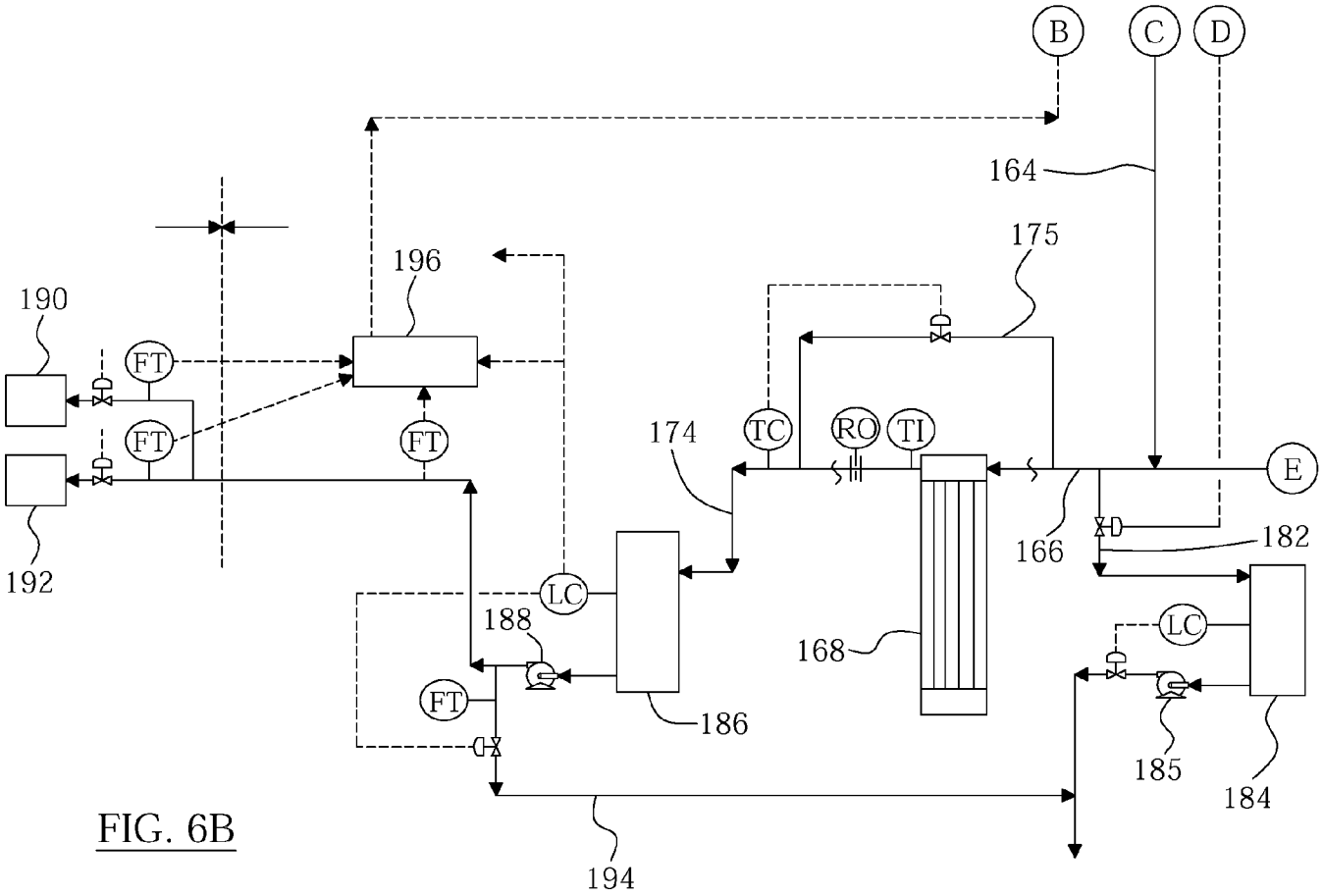
Figure 6C:
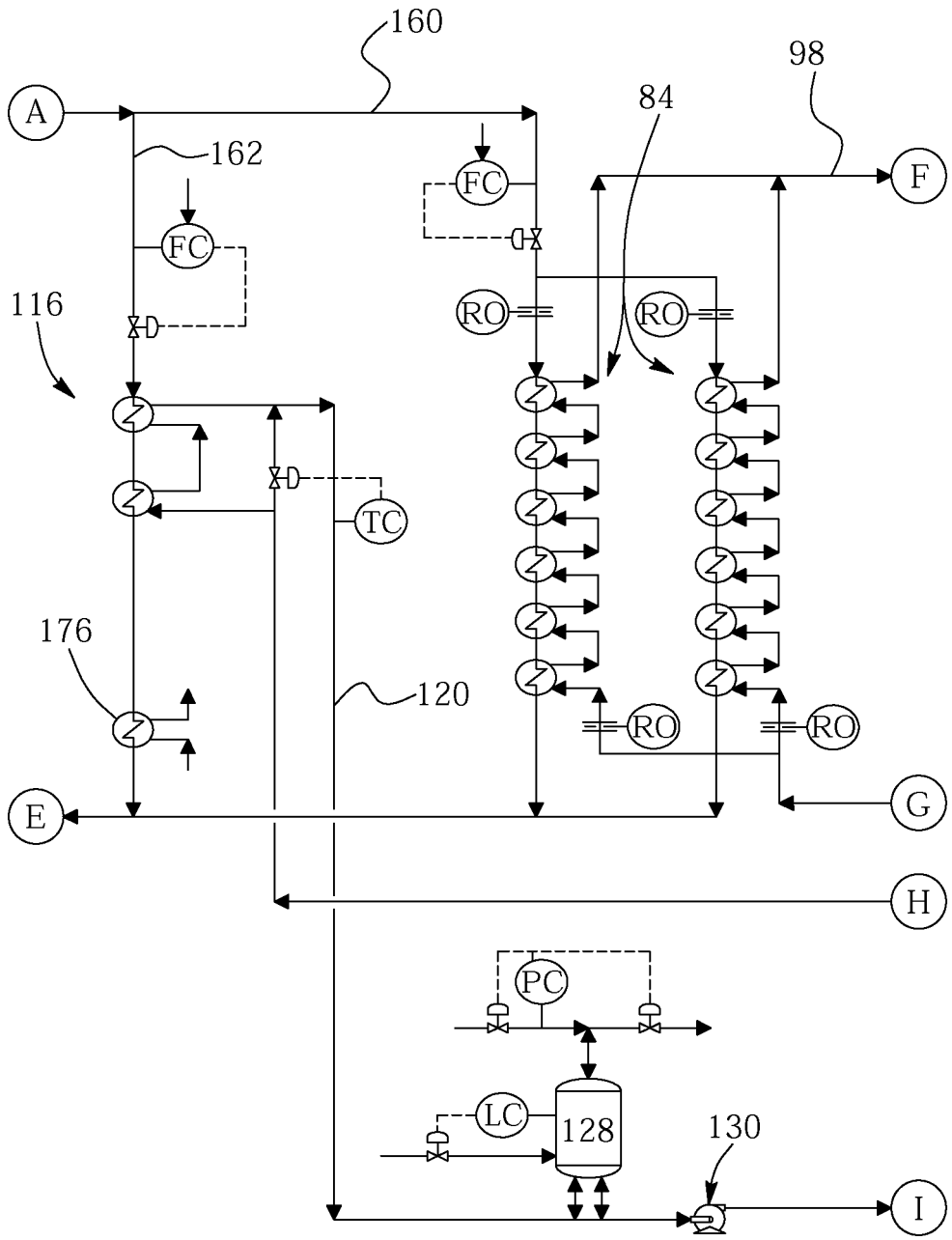
Figure 6D:
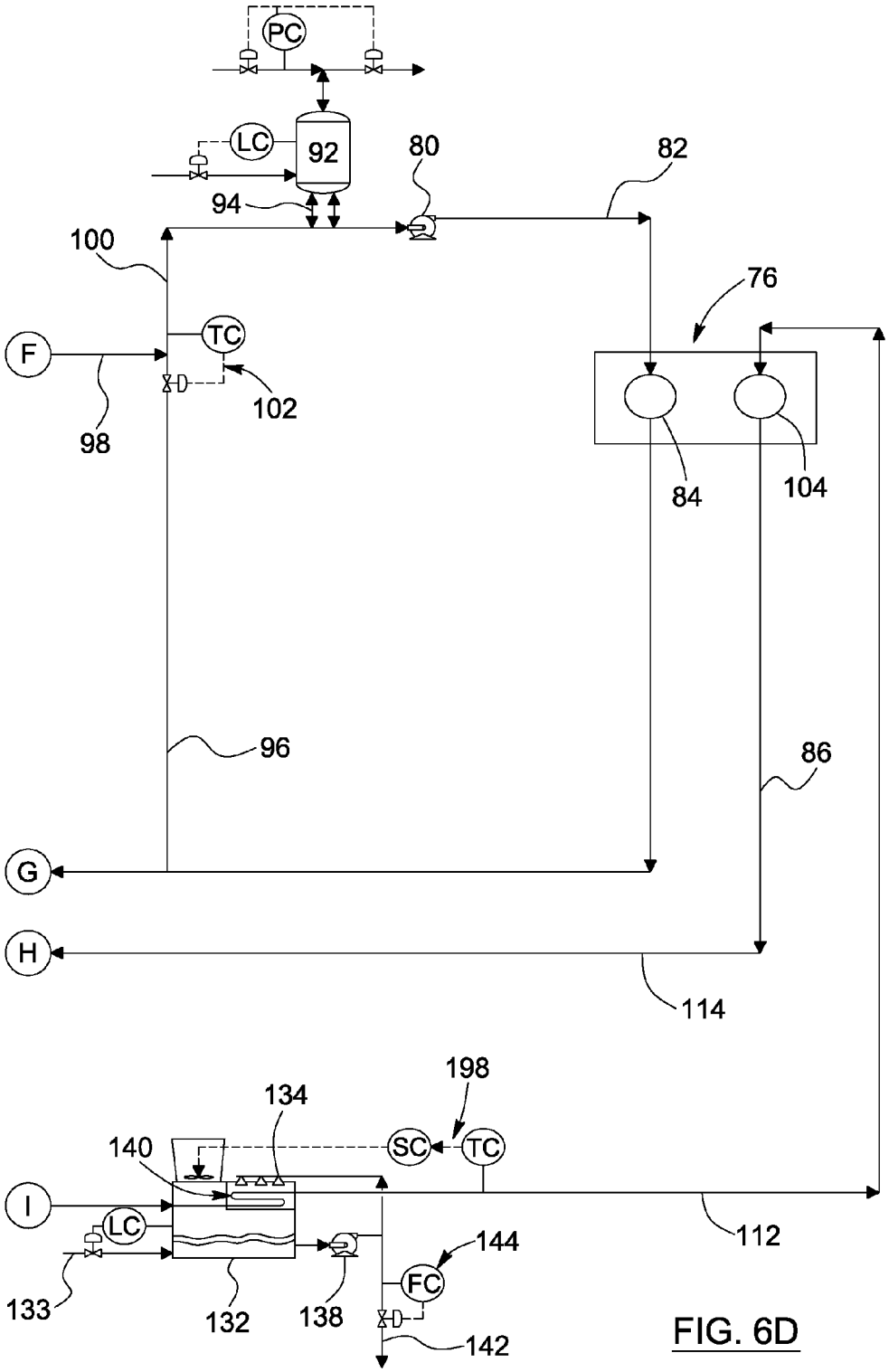

Referring to FIG. 4, a TSRU 52 may include one of more flash or stripping vessels 54, 56 for recovering solvent from the solvent diluted tailings 58 derived from the froth separation vessels. The first stripping vessel 54 receives the solvent diluted tailings 58 and steam 60 and produces overhead flashed solvent 62 and an underflow of partially solvent recovered tailings 64, which is supplied to the second stripping vessel 56. The overhead flashed solvent 62 may be condensed by a first TSRU condenser 66 and then further processed. The partially solvent recovered tailings 64 is separated into a second overhead solvent 68 and an underflow of solvent recovered tailings 70. The second overhead solvent 68 is preferably condensed in a second TSRU condenser 72 and then further processed or separated to produce a recovered solvent for reuse in the froth treatment operation.

Referring to FIGS. 1, 2, 5 and 6, in one aspect of the present invention, the froth treatment plant comprises heat exchangers for cooling and/or condensing froth treatment streams and employs heat removal circuits for removing heat from the froth treatment streams and transferring the heat to another oil sands process fluid.

Figure 1:
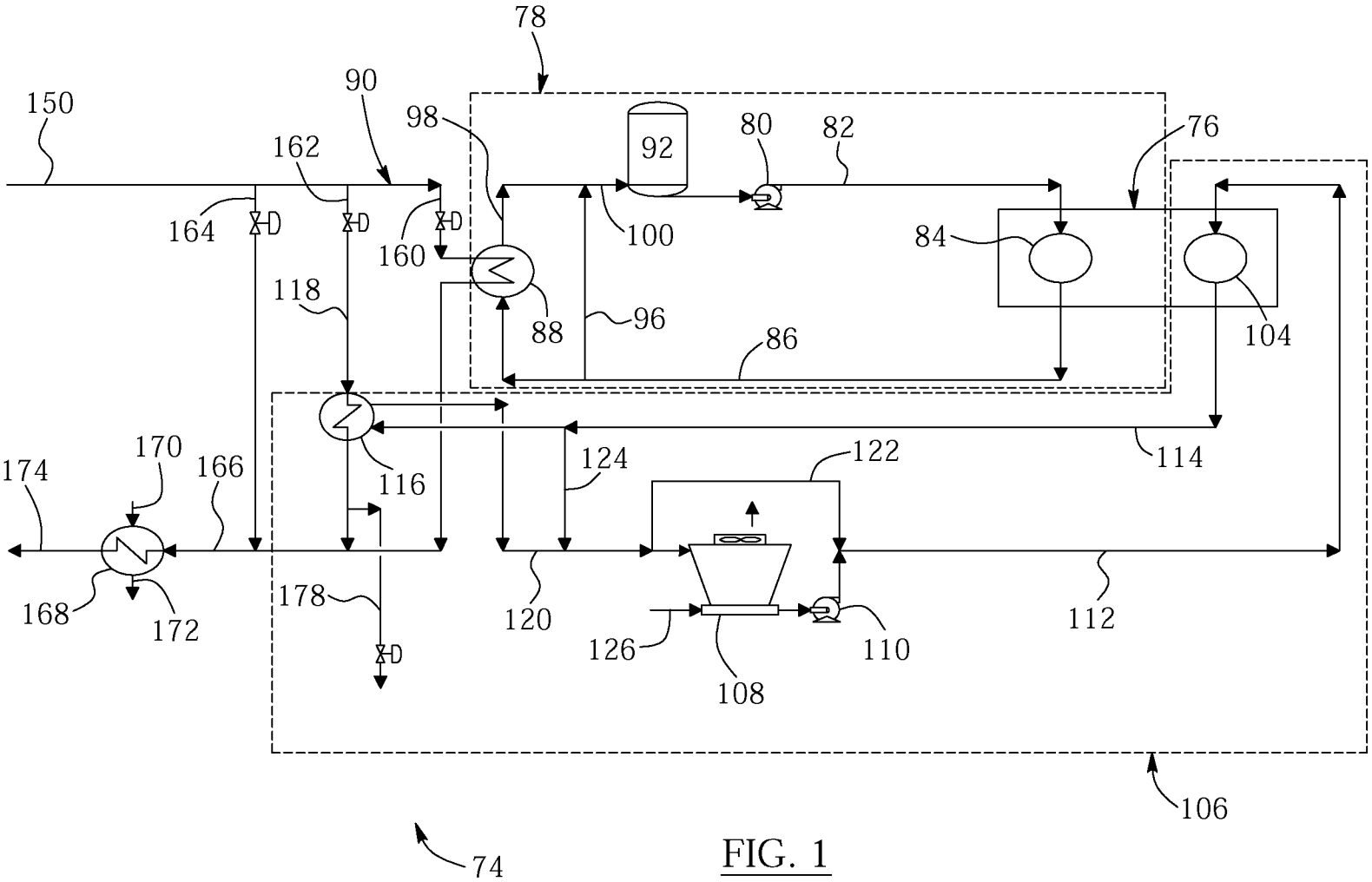
FIG. 1 is a process flow diagram of a heat removal and recovery system with a sealed closed loop cooling circuit and a tertiary cooling circuit according to an embodiment of the present invention.

Referring in particular to FIG. 1, in one aspect of the invention, there is a heat removal and recovery system 74 for removing heat from a froth treatment plant 76 and reusing it. It should be noted that the "heat removal and recovery system" may also be referred to herein using a variety of expressions such as a "heat recovery system", a "cooling system", "cooling circuit", "cooling loop", "heat recovery circuit", "heat transfer circuit" or other such variations. It should also be understood that while it may be referred to as a "cooling circuit" or "cooling system", the circuit may condense a froth treatment process stream such as flashed solvent at a constant temperature rather than actually lower the temperature of solvent stream. The invention provides various circuits that allow heat removal from a froth treatment plant for recovery and reuse in heating an oil sands processing stream such as process affected water for extraction operations.

In one aspect, the heat recovery system 74 includes a sealed closed-loop heat transfer system illustrated as within area 78 which includes a heat exchange media circulation pump 80 and supply piping 82 for circulating a heat exchange media through at least one froth treatment heat exchanger 84 which is preferably a high temperature cooling or condensing exchanger. The sealed closed-loop heat transfer system 78 also includes return piping 86 for returning heated media into heat recovery exchangers 88 where heat is transferred from the heated media to recycle process water circulated through a process water line 90 for example. As will be further described herein-below, the recycle process water is preferably heated for use in a bitumen ore extraction operation, for instance in a Clark Hot Water Extraction (CHWE) process to separate the bitumen from the ore and create an oil sands ore slurry.

In one aspect, the sealed closed-loop heat transfer system 78 can be viewed as a high temperature cooling circuit for recovering high grade heat from high temperature heat exchangers 84 in the froth treatment plant. For example, the high temperature heat exchangers may be condensing exchangers such as the SRU condensers 24, 34 and/or 48 illustrated in FIG. 3. More regarding this high grade heat recovery will be discussed herein-below.

Referring to FIG. 1, in one aspect, the high temperature cooling circuit 78 is pressurized, that is the cooling media which is circulated to remove heat from SRU condensing exchangers and provide heat to the recycled process water is maintained under pressure. The pressurized circulation loop configuration allows substantially avoiding static head requirements for the circulation pump while permitting heated cooling media to circulate. In one aspect, the cooling media in the circuit 78 is pressurized above the pressure of the process fluid being cooled or condensed in the high temperature heat exchangers 84. This enables several advantages. More particularly, if there is leakage between the cooling media and the process fluid, for instance due to damage to the exchanger walls, the higher pressure cooling media will leak into the process fluid line instead of the process fluid leaking into the cooling circuit. This allows improved leak detection since water based cooling media may be straightforwardly detected in solvent-based streams; preventing contamination of the cooling media with process fluid; and safeguarding against fouling within the cooling loop. In one preferred aspect, the cooling media pressure is maintained at least 10% above the pressure of the froth treatment process fluid. By maintaining the pressure of the heat exchange media above and preferably 10% above the pressure of the process fluid, e.g. solvent, helps prevent contamination of the cooling loop, since if there is a leak it will be from the cooling loop into the froth treatment process side. This is particularly advantageous since if the process stream leaks into the cooling system, exchangers can quickly foul and contaminant hydrocarbon phases can be detrimental and dangerous to cooling loop equipment such as cooling towers. On the other hand, water based cooling media can leak into the process side and be quickly detected using electrical based systems, since water conducts electricity and hydrocarbons do not.

Figure 2:
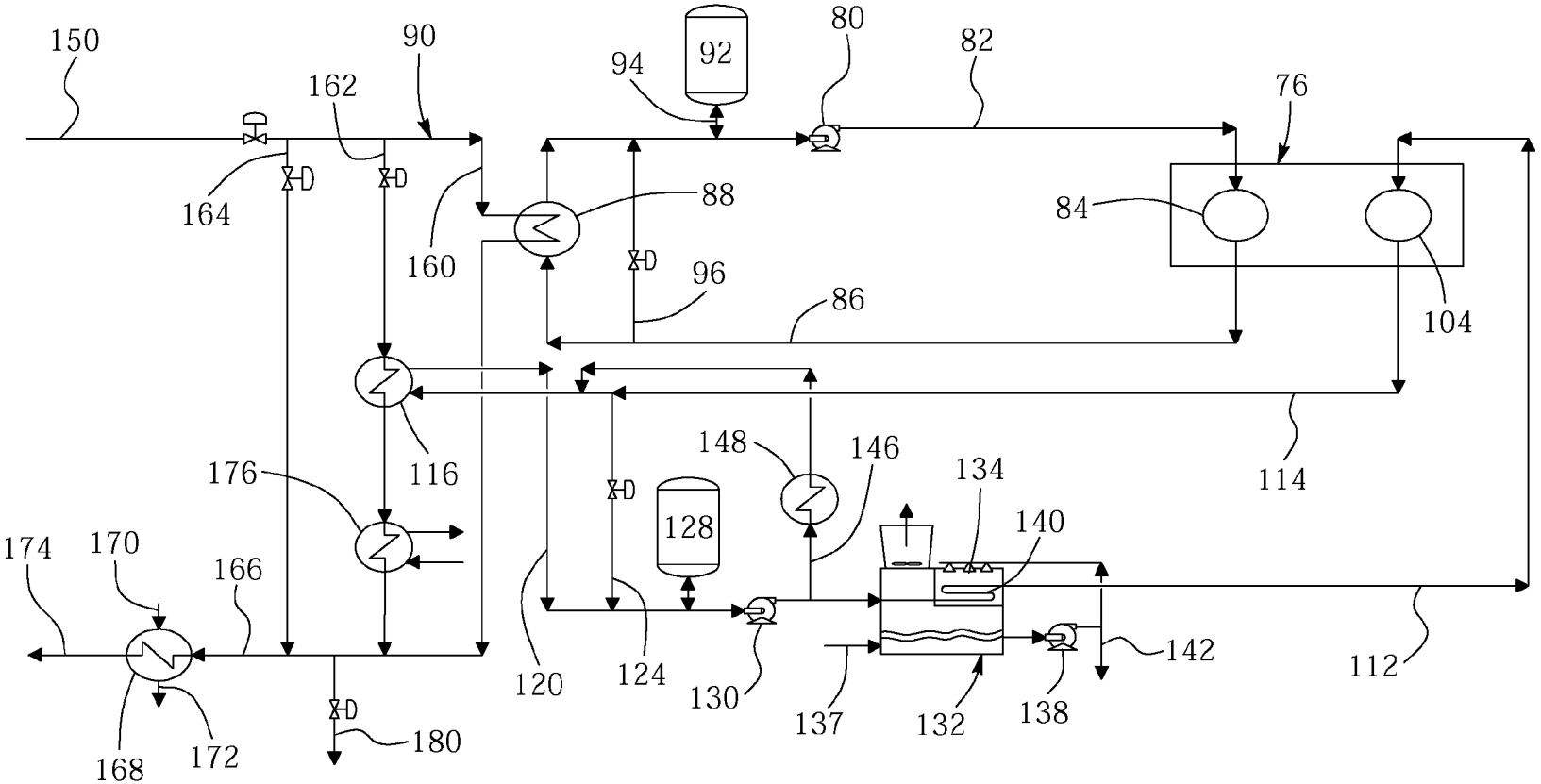
FIG. 2 is a process flow diagram of a heat removal and recovery system according to another embodiment of the present invention.

In another aspect, the high temperature cooling circuit 78 also includes a pressure regulation device 92 which is preferably a pressure expansion tank or similar device. The pressurized expansion tank 92 is preferably provided and configured to allow for fluid expansion and some surge capacity within the cooling circuit 78. The pressure expansion tank 92 maintains the cooling loop system pressure and absorbs volume swings in the system due to thermal expansion and contraction of the cooling media. The circulation of cooling media is under pressure and maintained to avoid flashing of the media at the process cooling temperatures. The pressure expansion tank 92 helps maintain system pressure. In FIGS. 2, 5 and 6 the pressure expansion tank 92 is illustrated as being connected to the system via a balance line 94, but it may also be connected in-line and provides an amount of surge capacity for leaks. A reserve tank (not illustrated) may also be provided for inventorying the system during unit outages. The expansion device 92 and the reserve tank are preferably sized, designed and controlled in connection with the selected cooling media and the overall system operating conditions to achieve the desired pressurization and surge capacity. It is also noted that the expansion tank 92 may be located into the supply line 82 or the return line 86 of the cooling circuit 78, which may be chosen partially based on the layout of the SRU heat exchangers 84 for example. In addition, the pressure regulation device 92 may be a bladder tank separating gas blanket from the media or one with a gas blanket in direct contact with the fluid media, a low pressure tank or "surge tank" with pumps and pressure relief possibilities, or a pump and regulation valve combination, for example. The circulation pump 80 compensates for hydraulic loss and the pressure tank or other regulation device regulates pressure.

In another aspect, the high temperature cooling circuit 78 also includes a hot media bypass line 96 for bypassing the heat recovery exchangers 88. This hot media bypass line may be used for temperature control of the cooled heat transfer media 98 exiting the heat recovery exchangers 88 to produce a temperature controlled heat exchange media 100. Referring to FIGS. 5 and 6, there may be a temperature control device 102 including a valve and controller arrangement.

In one aspect, there are multiple cooling circuits such as the cooling circuit 78 illustrated in FIG. 1 that are provided for recovering heat from froth treatment heat exchangers for reuse in heating process water for oil sands extraction operations or other purposes. It should be understood that each cooling circuit may be a sealed closed-loop circuit such circuit 78, coupled to a given set of froth treatment condensers and heat recovery exchangers.

In another aspect, referring to FIGS. 1 and 2, the froth treatment exchangers include high temperature cooling exchangers 84 and low temperature cooling exchangers 104. Preferably, there is a set of the high temperature cooling exchangers 84 and a set of the low temperature cooling exchangers 104. Each set of cooling exchangers may include exchangers associated with one or more of the froth treatment plant units such as the FSU, SRU and TSRU. Alternatively, each set of cooling exchangers may be associated with a corresponding one of the FSU, SRU or TSRU. The cooling exchangers are split into at least two sets by minimum cooling temperature needed. In one aspect, the set of high temperature cooling exchangers 84 is associated with the SRU, in particular with the condensers used to condense flashed overhead solvent, e.g. condensers 24, 34 and/or 48 illustrated in FIG. 3. The high temperature condensing exchangers 84 may operate to handle about 70% to about 80% of the cooling heat load of the SRU.

Referring to FIG. 1, in one optional aspect, the set of high temperature cooling exchangers 84 is associated with a sealed closed-loop cooling circuit 78 and the set of low temperature cooling exchangers 104 is associated with a separate cooling circuit which may be a closed loop or another type of cooling system.

The set of low temperature cooling exchangers 104 may be associated with the TSRU, in particular with the condensers used to condense flashed overhead solvent, e.g. condensers 66 and/or 72 illustrated in FIG. 4. The TSRU condensers are often required to operate as low pressures and thus are low heat condensers and preferably associated with a low temperature cooling loop.

More regarding the high and low temperature heat exchangers will be discussed herein-below.

Referring back to FIG. 1, a low temperature cooling circuit illustrated as within area 106 circulates from a cooling tower 108 which, with evaporative cooling, supplies cooling water at about 25° C. in summer. Of course, it should be noted that the temperature of the cooling water that is supplied may vary depending on weather and environmental conditions as well as process operational requirements. A cooling water circulation pump 110 provides the hydraulic head required to overcome friction and static heads to distribute the cooling water via a supply header 112 to the low temperature cooling exchangers 104. In one aspect, the heat pick-up by an individual low temperature cooling exchanger 104 may be limited up to about 60° C. as the temperature of the discharge cooling water, in order to minimize fouling potential due to water chemistry of the make-up water supply. The cooling water return line 114 may then return the heated cooling water to a low temperature heat recovery exchanger 116 that transfers heat from the heated cooling water to recycled process water 118. It should be understood that the heat transferred is affected seasonal factors. In summer, when recycle water temperatures are at or above 25° C., the cooling water with conventional exchangers used as the low temperature heat recovery exchanger 116 can achieve about 5° C. approach temperatures and the remaining heat must be removed by the cooling tower 108. In winter, when recycle water temperatures are about 4° C., conventional exchangers used as the low temperature heat recovery exchanger 116 can achieve the 25° C. cooling water circulation temperature; however, the cooling tower 108 is nevertheless preferably circulated to avoid damage due to ice formation.

Referring still to FIG. 1, the cooled cooling water is supplied from the heat recovery exchanger 116 to the cooling tower 108 via a cool water line 120. In some embodiments, there may be additional bypass lines to enable advantageous control of the system. In one aspect, there is a cooling tower bypass line 122 so that a portion of the cooled cooling water 120 can bypass the cooling tower. This bypassing can simplify the setup to control temperature and optimize heat exchanger design and operation with a consistent inlet cooling water temperature. In addition, there may be cooling water connection line 124 connecting the return line 114 to the cool water line 120. These lines 122 and 124 can aid in temperature control of the cooling water supplied to the cooling tower and the lower temperature heat exchangers and can also facilitate maintenance, cleaning or replacement of exchangers, cooling tower, and other bypassed equipment. There is also a make-up water line 126 for providing make-up water to the system.

Referring to FIGS. 5 and 6, the high and low temperature heat exchanger circuits may be respectively associated with a set of high temperature heat exchangers and a set of low temperature heat exchangers. The high temperature set is illustrated as having two parallel banks each comprising six heat exchangers in series. It should note noted that many variations or alternative arrangements may be employed.

Regarding the cooling heat exchangers of the high and low temperature sets, they may be configured in shell-and-tube arrangements to achieve maximum heat recovery from the froth treatment plant units for transfer via the corresponding cooling loop to the recycle process water at the highest temperature. The preferred heat exchangers are able to achieve approach temperatures down to about 5° C. Shell-and-tube exchangers are preferred though plate exchangers which can achieve approach temperatures down to about 2° C. may also be used and may even be advantageous, for instance for the low temperature heat recovery exchanger 116 shown in FIG. 1.

In one aspect, the high temperature heat exchangers 84 may be selected, designed or operated such that solvent is condensed at a condensation temperature between about 65° C. and about 130° C., preferably between about 80° C. and about 100° C., while the heat exchange media is heated from an inlet temperature between about 25° C. and about 40° C., preferably about 30° C., to an outlet temperature between about 80° C. and about 120° C. It is also noted that individual condensers may operate as low as 65° C., while the aggregate of the set may operate between 80° C. and 100° C. In another aspect, the low temperature heat exchangers 104 may be selected, designed or operated such that solvent is condensed at a condensation temperature between about 60° C. and about 80° C., while the cooling water is heated from an inlet temperature between about 4° C. and about 30° C., depending on seasonal conditions, to an outlet temperature between about 40° C. and about 60° C., preferably about 45° C.

Turning now to FIGS. 2 and 6, the low temperature cooling circuit may also be a sealed closed-loop circuit. In this embodiment, the low temperature cooling circuit preferably circulates a heat recovery medium similar to that for circuit 78 and includes a second expansion tank 128, a second pump 130 and sealed cooling tower 132. The sealed cooling tower may be a Wet Surface Air Cooler (WSAC™) or similar type cooling tower where heat exchange media to be cooled does not come into contact with the atmosphere or external cooling fluids, but rather is circulated within sealed coiled piping the exterior of which is sprayed with cooling water via a spray system 134. In particular, WSAC™ systems have re-circulated cooling water that cascades continuously over bundles of smooth tubes while air moves over the tube bundles in a downward direction that is concurrent with the cascading water. Heat is transferred by convection from the tube surfaces to the cascading cooling water and the flow of air mixes with the flow of cooling water, the flow of which is generally in the same downward direction. The cascade is at an equilibrium temperature as water evaporates to the air. The heat exchange media can thus be cooled indirectly by the sprayed or cascaded cooling water and can remain in the sealed closed-loop circuit without being contaminated or depressurized. FIGS. 2 and 6 illustrate a sealed cooling tower 132 having a make-up cooling water inlet 136 which provides make-up water into the bottom of the tower. The cooling water is pumped from the bottom of the cooling tower via a tower pump 138 to the spray system 134 which sprays cooling water onto sealed coiled piping 140 provided within the tower 132 and which contains the heat exchange media. There may also be a blowdown line 142 the flow of which is regulated by the tower pump 138 and a control device 144 shown in FIG. 6. The sealed closed cooling tower may be used instead of a cooling tower with decks over which water or media flashes.

Referring to FIG. 2, the second sealed closed-loop cooling circuit may also include a heated bypass line 146 including a bypass heat exchanger 148, for bypassing and heating the cooled cooling media exiting the second heat recovery exchanger 116 and recycling the heated media back upstream into the cooling water return line 114. This heated bypass line may be employed for providing additional heat to the process water, for temperature control purposes and/or allowing closed recirculation for upset conditions or maintenance of equipment when needed.

Referring now to FIGS. 1, 2, 5 and 6, the heat recovery and cooling circuits 78, 106 are preferably used to heat process water for use in oil sands extraction operations. In one aspect, cold process water 150 is provided via pipeline to at least one cooling circuit.

As shown in FIGS. 5 and 6, the cold process water 150 can be obtained from a pond inventory system 152 which includes a tailings and water pond 154 and a pumping reservoir system 156 which uses pumps 158 to supply the cold process water 150.

Referring to FIGS. 1, 2, 5 and 6, the cold process water may be heated by the heated media of the heat recovery and cooling circuits according to a variety of heat exchange configurations. In one embodiment, the cold process water may be split into multiple pipelines, such as a first process water line 160 which may be a high temperature line, a second process water line 162 which may be a low temperature line, and third process water line 164 which may be a bypass line that does not pass through any heat exchangers. As illustrated in the Figs, each of the lines 160, 162, 164 may split, bypass and/or pass through various heat exchangers and may also be controlled according to temperature and/or flow rate requirements.

The process water lines 160, 162, 164 preferably rejoin into a single hot process water line 166 containing heated process water for use in extraction operations.

Referring to FIGS. 1 and 2, the hot process water line 166 may pass through a final heat exchanger 168 which may use low pressure steam 170 to heat the process water to a final desired temperature, producing low pressure condensate 172 and a final hot process water stream 174. A bypass line 175 may be provided as its flow rate may be temperature controlled for obtaining the desired temperature at the outlet of the final heat exchanger 168. The final heat exchanger 166 may be located near consumers of heated process water to minimize heat losses during transmission.

Referring to FIGS. 2, 5 and 6, the process water lines may pass through other heat exchangers to optimally provide heat to the process water. For instance, there may be a condensate cooler or trim heater 176 to recover heat from steam condensed when heating process water in the final heat exchanger 168 downstream of the heat recovery heat exchanger 116.

In another aspect, one or more dump lines may be provided. FIG. 1 shows a second process water dump line 178, FIGS. 2 and 5 show a common heated process water dump line 180 and FIG. 6 shows an overall process water dump line 182. It should be noted that one or more of such dump lines may be used in connect with the process of the present invention. The dump lines may be designed and operated to enable several advantages. The low temperature process water dump line 178 allows disposing of lower temperature stream 162 compared to the high temperature stream 160, to meet the hydraulic and heat requirements of extraction without upsetting the froth treatment or wasting higher quality heat.

It is noted at this juncture that integration of a bitumen froth treatment plant and an oil sands extraction operation has a number of challenges related to coordinating the two operations during different operational conditions. For instance, both extraction and froth treatment experience a variety of upset conditions—startup, shutdown, turndown, maintenance, etc.—as well as normal processing conditions. The frequency, duration, location, magnitude and process-related implications of upset conditions vary significantly between extraction and froth treatment operations. Consequently, according to aspects of the present invention, the process is coordinated to overcome at least some of these challenges and mitigate inefficiencies and hazards associated with integration between extraction and froth treatment.

In one aspect, at least one process water dump line enables advantageous operational safety and efficiency of the froth treatment plant by adjusting to more frequent upset and downtimes of the extraction operation. More particularly, when the extraction operation experiences downtime—due to equipment failure, repair, relocation or temporary low quality or quantity oil sand ore, for example—it is advantageous not to reduce the cold process water supply for removing heat from the froth treatment operation via the heat recovery exchangers 84, 116, especially high temperature exchangers 84. The dump lines therefore enable the process water to recover heat from the froth treatment operation without interruption and then to bypass the extraction operation and be fed back into the pond water inventory or provided temporarily to other parts of the oil sands operations or facilities for heat reutilization. In one aspect, illustrated in FIG. 6, there may be a utilities dump tank 184 into which the overall process water dump line 182 supplies at least a portion of the hot process water depending on extraction upset conditions. It should also be noted that the utility dump tank 184 could be a dump pond configured for the upset capacity. It should also be noted that a portion of the hot process water could be recycled back to mix with the cold process water 150 as long as excessive heat does not build up in the cooling system and the heat exchange between the cold process water and the heated media maintains sufficient efficiency. There is also a dump tank pump 185 for supplying the process water to a utilities dump header to return the process water to the pond inventory.

Referring to FIG. 6, the final hot process water stream 174 may be fed to a holding tank 186 and a hot water supply pump 188 may supply the hot process water from the holding tank 186 to extraction operations 190, 192. There may also be a holding tank dump line 194 which is associated with a level control device for controlling the level of the holding tank 186.

In another aspect, illustrated in FIG. 6, there is a hot process water delivery management system 196, which manages various process equipment and conditions. The hot process water delivery management system 196 may be programmed or operated to maintain stable operation and to adapt to upset conditions in extraction and also froth treatment as need be.

Turning now to FIGS. 1, 2, 5 and 6, in a preferred aspect of the present invention, the heat exchange media and cooling water of the two cooling circuits are each controlled and maintained at respective constant temperatures at the inlet to the high and low temperature heat exchangers respectively. If the heat exchange media temperature fluctuates excessively, then the cooling or condensing in the heat removal exchangers 84, 104 will be inconsistent resulting in downstream problems in the froth treatment plant. FIG. 6 illustrates a possible temperature control setup 102 for maintaining a consistent temperature of the heat exchange media provided to the high temperature heat exchangers 84, as well as a second temperature control setup 198 for maintaining a consistent temperature of the second cooling circuit's heat exchange media provided to the low temperature heat exchangers 104. In addition, tight temperature control of the heat exchange media has the advantage of allowing smaller equipment design in the froth treatment plant since over-design for the sizing and number of equipment such as vessels and exchangers can be reduced. Furthermore, with a consistent supply temperature of the heat exchange media, the process can achieve consistent condensing or cooling of the solvent stream and avoid over-cooling which would require reheating the solvent for reuse in the froth treatment operation and thus cause inefficient energy use.

It should also be noted that although the illustrated embodiments show two heat transfer loops, there may be more than two loops associated with a corresponding set of condensers, heat recovery exchangers and trim cooling devices such as cooling towers. Alternatively, there may also be a single heat exchange loop combining the high and low temperature cooling circuits with appropriate piping, trim cooling devices, bypass lines, temperature and flow control devices and heat exchanger configurations.

Nevertheless, in a preferred embodiment of the present invention, there is at least a first sealed closed-loop heat transfer circuit coupled with the high temperature SRU condensers of a paraffinic froth treatment (PFT) plant. It should be noted that the SRU condensers may be operated at a variety of conditions, depending on sizing, economics and other design criteria. By way of example, the SRU solvent condensers may be operated at a pressure of about 500 kPaa and condense the solvent at a temperature of about 60° C.; the SRU solvent condensers may alternatively be run at a pressure of about 200 kPaa and condense the solvent at a temperature in a range of 25° C. to 40° C.

In one aspect, the present invention improves energy efficiency by minimizing requirements for transferring large flow rates of process water over long distances for use in extraction operations. In a high temperature PFT operation, for instance, the cooling duty is relatively fixed by design and for this fixed cooling load increasing the temperature of the process water reduces flow requirements for the final hot process water. Given that $Q=mC\Delta T$, an increase in $\Delta T$ for a same energy (Q) requirement corresponds to a decrease in mass flow rate (m) requirement. Since embodiments of the present invention allow the hot process water supplied to extraction to be at a higher temperature, the flow rate requirement is decreased, resulting in a corresponding decrease in equipment size and cost, e.g. reduced pipeline size, pump number, pump horse power requirements. This provides further design flexibility for smaller equipment resulting in significant cost savings. By way of example, in practice with a $\Delta T$ of about 30° C. there may be as much as a 40% reduction in flow requirements for the same heat transfer, though this will depend on the configuration of the SRU. In one aspect, the high temperature process water is supplied to the extraction operation and before utilization it is combined with an amount of local cold process water (not illustrated) to achieve a desired temperature of the process water utilized in the given extraction unit.

In one aspect, the maximum temperature of the heat exchange media from a high temperature process exchanger may be limited by the selected heat exchange media and may approach up to about 120° C. The temperature of recycled process water will fluctuate to reflect the seasonal temperature variations of recycled process water. Preferably, the heat recovery exchangers recover the heat into the process water at the highest practical temperature and minimize trim heating demands. Optional heat transfer arrangements and trim heaters for the heating of recycled process water are further described herein and illustrated in the Figs.

It is noted that the heated cooling media and the heated cooling water may both transfer heat to the same stream of recycle process water, different streams of recycle process water or, alternatively, to other process streams in oil sands mining, extraction, in situ recovery or upgrading operations or a combination thereof. Heat requirements, pipeline infrastructure, proximity of the froth treatment plant and cooling loops to other process streams and economics in general are factors that will influence where the heat removed by the cooling loops will be transferred.

Referring to FIGS. 1, 2, 5 and 6, in one preferred aspect the heated cooling media and the heated cooling water transfer heat to recycle process water which is used in bitumen mining and extraction operations. As recycle process water has high fouling characteristics, the high and low temperature heat recovery exchangers 84 and 116 may each have spares installed to permit on-line cleaning. Isolation valves and associated systems for exchanger cleaning are not illustrated in detail but may be used in connection with various embodiments of the present invention.

In one non-illustrated embodiment, the low temperature heat recovery exchangers 116 may be configured to preheat the recycle water upstream of the high temperature heat recovery exchangers 84, thus being in a series configuration. This configuration may provide advantages such as reducing some seasonal variations due to recycle water temperatures.

The cold recycle process water may be split into multiple streams for low temperature heat exchange and high temperature heat exchange and the streams may be recombined for use in the same extraction operation, for example. Alternatively, each of the heated streams may be used for different applications, depending on their temperatures and flow rates.

Embodiments of the present invention provide a number of advantages, some of which will now be described. In general, the cooling system provides reliable recovery of high grade heat available from process exchangers that exceed the temperatures for heat recovery by regular closed-loop or open-loop cooling water systems.

The use of clean circulating heat exchange media, also referred to herein as "cooling media", permits additional and advanced process control options that are not available in conventional cooling water systems that employ unclean recycle waters.

In addition, the sealed closed-loop system is maintained under pressure to prevent liquid flashing and, as the static head up to the process exchangers—typically in the order of about 30 m to about 40 m—is recovered on the return side, the power required by the circulation pump is reduced to line and equipment pressure losses.

Furthermore, the circulating cooling media may be water or other heat transfer media and mixtures, which may be maintained in a clean state and may have with appropriate anti-fouling inhibitors suitable for operation conditions, thus improving the heat transfer efficiency and performance. Thus, the cooling media for the sealed closed-loop circuit is preferably selected as a non-fouling clean media avoiding the issues related to contaminated process water due to dissolved oxygen, suspended solids, scaling potential and bitumen fouling. This reduces fouling, scaling, erosion and corrosion in the sealed closed-loop circuit.

In addition, as the cooling system is sealed and pressurized, make-up requirements are only required in the rare case that leaks occur, which provides advantages over the conventional closed loop systems that require continuous make-up of treated water and blowdown of water with associated cost and environmental downsides.

Furthermore, the cooling media in the sealed cooling loop is selected for low fouling and efficient heat transfer properties at high cooling temperatures which provides a number of functions. High temperature heat integration of the SRU with the froth treatment plant is enabled, with temperatures ranging between about 60° C. and about 120° C. or even higher temperatures. In addition, low fouling cooling media eliminates or greatly reduces the requirement of providing spare process heat exchangers or advanced and costly metallurgical solutions for corrosion and erosion resistance. By avoiding spares for online maintenance purposes, piping and valve arrangements can be simplified for increased efficiency. In addition, since in typical cooling loops fouling by cooling water limits velocity ranges for process control to the process side, by using clean non-fouling cooling media flow control can be provided from the cooling side of the exchangers allowing optimization to individual exchangers especially where multiple exchangers are used in parallel, as shown in FIGS. 5 and 6 for example. Due to the large flow rates in SRUs, multiple exchangers in parallel are common and often necessary. In addition, recovery of heat at higher temperatures increases reuse opportunities. In the case of oil sands operations, this minimizes trim heating requirements for hot process water used in bitumen extraction. In addition, design and maintenance of high heat recovery exchangers can focus on effective management of fouling due to the characteristics recycled process water. Since the cooling media passes through the shell side and the recycle process water passes through the tube side of the shell-and-tube heat exchangers and cleaning of tubes is generally easier than the shell side, using clean cooling media enhances cleaning and maintenance of the heat exchangers. It is also noted that cleaning systems exist for online cleaning of heat exchanger tubes and these may be used in connection with embodiments of the present invention for further enhancements.

In addition, the location of the high temperature heat exchangers may be adjacent or within given froth treatment plant units, e.g. the SRU. In one aspect, the high heat recovery exchangers are located close or within the SRU, which allows the supply and return pipeline lengths to be minimized relative to conventional cooling systems with towers. In another aspect, placement of the high heat recovery exchangers at grade with good access minimizes inefficiencies and difficulties related to accessibility for cleaning, which is particularly preferred when recycle process water has high fouling or frequent cleaning requirements.

In one aspect, the sealed closed-loop cooling system may be used in parallel with a conventional open- or closed-loop system such that the cooling systems service different sets of heat exchangers.

In another aspect, the cooling media for the high temperature closed cooling loop comprises or consists essentially of demineralized water. The cooling media may contain suitable chemical additives to enhance heat transfer or inhibit freezing during winter operations. Preferably, the composition of the cooling media is provided to limit exchanger fouling at the cooling conditions of process cooling exchangers.

In another aspect, sparing of the circulation pumps may be provided as the redundancy provides backup reliability for the system.

In another aspect, the split between high and low temperature process cooling exchangers increases the high grade heat recovery capability for reuse in the recycle process water system while reducing the need to spare exchangers for fouling by the clean cooling media.

In another optional aspect, the cooling media recovers heat from an SRU condensing exchanger and the heated media then transfers its heat to another stream within the froth treatment plant, e.g. in the FSU, the TSRU or another stream in the SRU itself, if need during particular operational conditions. The maximizing of heat recovery and reuse for other process purposes minimizes heat derived from combustion of fuel gas or hydrocarbons and greenhouse gas emissions with associated carbon credits for reduced emissions.

In another aspect, a high temperature PFT complex may have associated coolers to cool process streams during plant outages and these intermittent streams may be on the low temperature loop.

In another aspect, the froth treatment complex may use a naphtha solvent as diluent in lieu of paraffinic solvent with closed loop closing systems optimally cooling and condensing recovered naphtha diluent in diluent recovery plants or naphtha recovery plants.

In another aspect, while FIG. 1 illustrates a case in which there are two cooling loops, there may also be intermediate loops that are separate, linked or temporarily integrated with one or both of the cooling loops. Some intermediate loop integration with the other loops may allow streams or portions thereof to be withdrawn, added, exchanged between loops or recirculated in a variety of ways.

There are still other advantages of using embodiments of the sealed closed-loop cooling system of the present invention. Carbon steel materials may be used throughout the system, giving lower capital expenditure for the many heat exchangers in froth treatment operations. The system enables significantly lower maintenance costs. In addition, using two cooling circuits, such as sealed closed-loop circuit 78 and the "tertiary cooling circuit" 106 illustrated in FIG. 1, enables advantageous recovery of high grade heat while ensuring additional recovery of low grade heat and facilitates achieving the desired cooling of TSRU and SRU condensers. Furthermore, duplex heat exchangers may be replaced with carbon steel, resulting in significant capital cost reduction. The number of spare exchangers can also be reduced, further decreasing capital costs. The spare exchangers required may be based on clean service fouling factors, for example. In some case, it may be preferred to run a single cooling loop during summer peak periods, e.g. about two months of the year, with adjustments in froth treatment such as TSRU second stage and chiller capacity being performed as required. It should also be understood that there are significant operating expenditure savings with the sealed closed-loop heat recovery system.

Finally, it should be understood that the present invention is not limited to the particular embodiments and aspects described and illustrated herein.

The invention claimed is:

1. A system for recovering heat from a bitumen froth treatment plant, the system comprising:

a heat removal exchanger associated with the bitumen froth treatment plant and receiving a hot froth treatment process stream;

a heat recovery exchanger;

a sealed closed-loop heat transfer circuit comprising:

piping for circulating a heat exchange media having uncontaminated and low fouling properties, the piping comprising:

a supply line for providing the heat exchange media to the heat removal exchanger to remove heat from the hot froth treatment process stream and produce a heated media; and a return line for providing the heated media from the heat removal exchanger to the heat recovery exchanger;

a pump for pressurizing and pumping the heat exchange media through the piping;

a pressure regulator in fluid communication with the piping for regulating pressure of the heat exchange media; and wherein the pump and the pressure regulator are configured to maintain the heat exchange media under pressure and in liquid phase within the piping; and an oil sands process fluid line for supplying an oil sands process fluid to the heat recovery exchanger to allow the heated media to heat the oil sands process fluid, thereby producing a heated oil sands process fluid and a cooled heat exchange media for reuse in the heat removal exchanger.

2. The system of claim 1, comprising:

a second heat removal exchanger associated with the bitumen froth treatment plant and receiving a second froth treatment process stream that is cooler than the hot froth treatment process stream;

a second heat recovery exchanger;

a second heat transfer circuit for circulating a cooling media to the second heat removal exchanger to remove heat from the second froth treatment process stream and produce a heated cooling media and providing the same to the second the heat recovery exchanger.

3. The system of claim 1, comprising a sealed cooling tower coupled to the sealed closed-loop heat transfer circuit for trim cooling of the heat exchange media discharged from the heat recovery exchanger.

4. The system of claim 1, wherein the bitumen froth treatment plant is a high temperature paraffinic froth treatment plant or a naphthenic froth treatment plant.

5. A process for recovering heat from a bitumen froth treatment plant, the process comprising:

providing sealed closed-loop heat transfer circuit for circulating a heat exchange media having low fouling properties;

removing heat from a hot froth treatment stream into the heat exchange media to produce a heated media;

transferring heat from the heated media to an oil sands process fluid to produce a heated oil sands process fluid and a cooled heat exchange media; and pressurizing and regulating pressure of the heat exchange media within the sealed closed-loop heat transfer circuit to maintain the heat exchange media under pressure and in liquid phase.

6. The process of claim 5, wherein the step of removing heat comprises condensing a vapour phase solvent as the hot froth treatment stream in a solvent condenser.

7. The process of claim 6, comprising condensing the vapour phase solvent at a condensation temperature between about 65° C. and about 1130° C.

8. The process of claim 6, comprising heating the heat exchange media in the solvent condenser from an inlet temperature between about 25° C. and about 40° C. to an outlet temperature between about 80° C. and about 120° C.

9. The process of claim 5, wherein the pressure of the heat exchange media is maintained at least 10% above the pressure of the process stream.

10. The process of claim 5, wherein the pressure of the heat exchange media is maintained between about 300 kPaa and about 800 kPaa.

11. The process of claim 5, comprising:

providing a second heat transfer circuit for circulating a cooling media;

removing heat from a second froth treatment process stream that is cooler than the hot froth treatment process stream into the cooling media; and transferring heat from the heated cooling media to the oil sands process fluid.

12. The process of claim 11, wherein the step of removing heat comprises condensing a second vapour phase solvent as the second froth treatment stream in a low temperature solvent condenser.

13. The process of claim 12, wherein the vapour phase solvent is condensed at a condensation temperature between about 60° C. and about 80° C.

14. The process of claim 12, wherein step of removing heat comprising heating the cooling media from an inlet temperature between about 4° C. and about 30° C. to an outlet temperature between about 40° C. and about 60° C.

15. The process of claim 11, wherein the step of transferring heat from the heated cooling media is performed in a second heat recovery exchanger.

16. The process of claim 15, wherein the second heat recovery exchanger is a shell-and-tube type heat exchanger comprising tubes receiving the oil sands process fluid and a shell receiving the heated cooling media.

17. The process of claim 11, comprising a cooling tower coupled to the second heat transfer circuit for receiving the cooling media and providing a cooled cooling media for reuse in the step of removing heat from the second froth treatment process.

18. The process of claim 5, comprising trim cooling the heat exchange media using a sealed cooling tower coupled to the sealed closed-loop heat transfer circuit.

19. The process of claim 5, wherein the froth treatment plant is a high temperature paraffinic froth treatment plant.

20. A system for recovering heat from a bitumen froth treatment plant, the system comprising:

a set of high temperature cooling exchangers associated with the bitumen froth treatment plant;

a set of low temperature cooling exchangers associated with the bitumen froth treatment plant;

a high temperature circulation loop for circulating heat exchange media for recovering heat from the set of high temperature cooling exchangers to produce a heated media;

a low temperature circulation loop for circulating a cooling media for recovering heat from the set of low temperature cooling exchangers and producing a heated cooling media;

at least one oil sands process fluid line, each oil sands process fluid line in heat exchange connection with at least one of the high temperature circulation loop and the low temperature circulation loop, such that the heated media and the heated cooling media transfer heat to the corresponding one of the at least one the oil sands process fluid to produce a corresponding at least one heated process fluid.

21. The system of claim 20, wherein one of the at least one oil sands process fluid line is in heat exchange connection with both the high temperature heat recovery circulation loop and the low temperature heat recovery circulation loop for receiving heat there-from.

22. The system of claim 21, comprising a high temperature heat exchanger connected to the high temperature circulation loop and the oil sands process fluid line.

23. The system of claim 20, wherein the set of high temperature cooling exchangers are associated with a froth separation unit (FSU), a solvent recovery unit (SRU) or a tailings solvent recovery unit (TSRU) or a combination thereof in the bitumen froth treatment plant.

24. A process for recovering heat form a bitumen froth treatment plant, the process comprising:

providing a set of high temperature cooling exchangers and a set of low temperature cooling exchangers associated with the bitumen froth treatment plant;

circulating a heat exchange media through a high temperature circulation loop for recovering heat from the set of high temperature cooling exchangers and producing a heated media;

circulating a cooling media through a low temperature circulation loop for recovering heat from the set of low temperature cooling exchanger and producing a heated cooling media; and transferring heat from the heated media and the heated cooling media to at least one oil sands process fluid line to produce at least one heated process fluid.

25. A process for producing bitumen, comprising:

supplying bitumen froth to a bitumen froth treatment plant to produce the bitumen;

recovering heat from the bitumen froth treatment plant, wherein the recovering comprises:

providing sealed closed-loop heat transfer circuit for circulating a heat exchange media having low fouling properties;

removing heat from a hot froth treatment stream into the heat exchange media to produce a heated media;

transferring heat from the heated media to an oil sands process fluid to produce a heated oil sands process fluid and a cooled heat exchange media; and pressurizing and regulating pressure of the heat exchange media within the sealed closed-loop heat transfer circuit to maintain the heat exchange media under pressure and in liquid phase.

26. A process for producing bitumen, comprising:

supplying bitumen froth to a bitumen froth treatment plant to produce the bitumen;

recovering heat from the bitumen froth treatment plant, wherein the recovering comprises;

providing a set of high temperature cooling exchangers and a set of low temperature cooling exchangers associated with the bitumen froth treatment plant;

circulating a heat exchange media through a high temperature circulation loop for recovering heat from the set of high temperature cooling exchangers and producing a heated media;

circulating a cooling media through a low temperature circulation loop for recovering heat from the set of low temperature cooling exchangers and producing a heated cooling media; and transferring heat from the heated media and the heated cooling media to at least one oil sands process fluid line to produce at least one heated process fluid.

* * * * *